US010144539B2

(12) United States Patent
Lang et al.

(10) Patent No.: US 10,144,539 B2
(45) Date of Patent: Dec. 4, 2018

(54) PACKAGING MACHINE AND METHOD WITH LOOSE OBJECT CARRIER

(71) Applicant: Multivac Sepp Haggenmüller GmbH & Co. KG, Wolfertschwenden (DE)

(72) Inventors: Michael Lang, Buching (DE); Lars Ickert, Kempten (DE); Alireza Taghipour, Kempten (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 856 days.

(21) Appl. No.: 14/566,994

(22) Filed: Dec. 11, 2014

(65) Prior Publication Data

US 2015/0166203 A1 Jun. 18, 2015

(30) Foreign Application Priority Data

Dec. 12, 2013 (DE) ..... 10 2013 021 146

(51) Int. Cl.

| | |
|---|---|
| ***B65B 5/06*** | (2006.01) |
| ***B65B 7/16*** | (2006.01) |
| ***B65B 31/02*** | (2006.01) |
| ***B65B 35/44*** | (2006.01) |
| ***B65B 51/04*** | (2006.01) |
| ***B65B 51/14*** | (2006.01) |
| ***B65B 61/28*** | (2006.01) |

(52) U.S. Cl.

CPC ..... *B65B 5/068* (2013.01); *B65B 7/164* (2013.01); *B65B 31/028* (2013.01); *B65B 35/44* (2013.01); *B65B 51/04* (2013.01); *B65B 51/14* (2013.01); *B65B 61/28* (2013.01)

(58) Field of Classification Search

CPC ..... B65B 31/028; B65B 35/44; B65G 17/002
USPC ..... 53/300, 432; 198/465.1
See application file for complete search history.

(56) References Cited

U.S. PATENT DOCUMENTS 1,928,934 A * 10/1933 Green ..... B65G 17/002 198/377.02
3,587,829 A * 6/1971 Sorensen ..... B65B 7/164 198/834
3,668,820 A * 6/1972 Parvin ..... B65B 7/164 53/510

(Continued)

FOREIGN PATENT DOCUMENTS

FR 2725692 A1 4/1996
NL 9202176 A 3/1994

*Primary Examiner* — Andrew M Tecco
*Assistant Examiner* — Patrick Fry
(74) *Attorney, Agent, or Firm* — Husch Blackwell LLP

(57) ABSTRACT

The present invention relates to a packaging machine comprising a sealing station, a conveying unit and at least one loose object carrier, which is configured for accommodating a plurality of packaging objects and adapted to be fed to and removed from the sealing station by means of the conveying unit, wherein the loose object carrier comprises an upper part for accommodating the packaging objects, and wherein, for sealing the packaging objects, the object carrier is movable within the sealing station from a preliminary position, to which it can be advanced by means of the conveying unit, to a sealing position, at which it has been moved into contact with a tool upper part of the sealing station, said sealing position being displaced in parallel relative to the preliminary position.

16 Claims, 15 Drawing Sheets

(56) References Cited

U.S. PATENT DOCUMENTS 3,792,567 A * 2/1974 Balcome ..... B65B 7/164 53/282
3,890,767 A * 6/1975 Cawrse ..... B65B 7/2807 53/296
3,971,188 A * 7/1976 Cawrse ..... B65B 7/2807 53/478
4,712,670 A * 12/1987 Burkhardt ..... B65G 17/24 198/465.1
4,736,568 A * 4/1988 Shaw ..... B29C 65/18 53/290
4,866,907 A * 9/1989 Iuchi ..... B65B 7/28 53/299
4,901,504 A * 2/1990 Tsuji ..... B65B 7/2807 53/247
4,974,392 A * 12/1990 Mondini ..... B65B 7/164 198/468.1
5,155,971 A * 10/1992 Zopf ..... B65B 31/04 53/408
5,295,343 A * 3/1994 Ueda ..... B29C 65/7841 53/329.5
5,371,996 A * 12/1994 Ueda ..... B65B 7/164 53/298
5,475,965 A * 12/1995 Mondini ..... B29C 65/02 198/468.1
5,884,753 A * 3/1999 Robertson ..... B65G 15/02 198/803.2
6,540,064 B1 * 4/2003 Bodewes ..... B61B 13/00 198/346.1
6,688,453 B2 * 2/2004 Alviar ..... B65G 17/002 198/346.1
6,912,828 B1 * 7/2005 Yamay ..... B65B 31/028 53/300
7,971,709 B2 * 7/2011 Krups ..... B61B 10/043 198/465.1
9,296,505 B2 * 3/2016 Osterrieder ..... B65B 31/028
2012/0272623 A1 * 11/2012 Osterrieder ..... B65B 31/028 53/485
2014/0069054 A1 * 3/2014 Gabler ..... B65B 7/162 53/329
2016/0236809 A1 * 8/2016 Ickert ..... B65B 7/164

* cited by examiner

PACKAGING MACHINE AND METHOD WITH LOOSE OBJECT CARRIER

CROSS-REFERENCE TO RELATED APPLICATIONS

This application claims priority to German Patent Application Number 102013021146.8 filed Dec. 12, 2013, to Michael Lang et al., currently pending, the entire disclosure of which is incorporated herein by reference.

FIELD OF THE INVENTION

The present invention relates to a packaging machine as well as to a method of sealing a plurality of packaging objects.

BACKGROUND OF THE INVENTION

Tray packaging machines are also referred to as "tray sealers" among experts. The most widely used type of such packaging machines is provided with one or a plurality of conveyor belts onto which the trays are placed and on which the trays are conveyed into a sealing station and out of the sealing station. To this end, the trays must, however, have a shape with a sufficiently large bottom area so that they will not shift, let alone fall over on the conveyor belts.

In another, also widely used type of packaging machines, the machines are provided with a tray conveyor including tray accommodation means. A conveyor of this type, configured as a plate chain, is disclosed in EP 1 038 773 B1. Such plate chains can ensure safe transport of the packaging objects accommodated therein, but they are cost-intensive and necessitate a great amount of maintenance work. In addition, plate chains can often only be used in combination with a special packaging machine and cannot be used on different types of packaging machines.

Another packaging machine is disclosed in EP 2 447 169 A2. The tray sealer described therein comprises, according to a first embodiment, a tray conveyor configured as a plate chain by means of which trays are supplied to and discharged from the tray sealer. The drawback of this arrangement is that the tray conveyor can only be used for a single type of trays and that changeover operations at the tray conveyor are time-consuming and cost-intensive. In addition, this tray conveyor can only be used in combination with special tray sealers, especially since the tool lower part and the tool upper part of the sealing station must be adapted to the plate chain conveyor. Finally, in practice excessively large distances between the individual trays exist in the case of a conveyor configured as a plate chain. This, however, also entails the restriction that an increased amount of cover-film waste material will have to be dealt with.

According to EP 2 447 169 A2 a frame member is used as a tray conveyor, which is shown in a schematic representation and by means of which a plurality of trays can be supplied to the tray sealer. After the sealing process, the empty frame members can be returned to the infeed station along a horizontal return facility, such as a rail. In the case of this embodiment, it is in particular problematic to accurately position the frame member during the sealing process relative to the tool lower part and the tool upper part of the tray sealer.

Another object carrier, which feeds a contact lens package to a sealing station, is disclosed in DE 603 18 868 T2.

DE 10 2008 030 510 A1 discloses a packaging machine with a gripper system. The gripper system collects from a feed belt a plurality of loose trays to be sealed and feeds them to a sealing station. Trays which have already been sealed are transferable from the sealing station to a discharge belt by means of the gripper system in the same operating cycle.

KR 101 104 401 B1 discloses another packaging machine including a tray conveyor configured as a plate chain where tray accommodation members are integrated in the plate chain and are intermittently fed to a sealing station.

Another conventional tray conveyor with integrated tray carriers is disclosed in Applicant's DE 199 12 491 A1. The plate chain disclosed therein is able to feed a plurality of trays to the sealing station per work cycle. This, however, leads to a high weight of the plate chain and necessitates a high input power.

DE 103 07 918 A1 discloses a method and a device for centering a cup in a cup filling machine. According to this method, the cup is centered in an opening provided in a cell plate by means of a suction device arranged below the cell plate.

SUMMARY OF THE INVENTION

It is the object of the present invention to provide a packaging machine and a method of operating the same, which has improved flexibility of use and which can be used more economically, especially with regards to the drawbacks mentioned hereinbefore in connection with known packaging machines.

The packaging machine according to one embodiment of the present invention comprises a sealing station, a conveying unit and at least one loose object carrier, which is configured for accommodating a plurality of packaging objects and adapted to be fed to and removed from the sealing station by means of the conveying unit. The term "loose" may be defined as meaning that the object carrier is not coupled in a permanently fixed manner or via a hinge to other parts of the packaging machine, in particular not to other object carriers. The object carrier may include an upper part for accommodating the packaging objects. The tray sealer according to one embodiment of the present invention is characterized in that, for sealing the packaging objects, the object carrier is movable within the sealing station from a preliminary position, to which it can be advanced by means of the conveying unit, to a sealing position, at which it has been moved into contact with a tool upper part of the sealing station, said sealing position being displaced in parallel relative to the preliminary position. The loose object carrier may operate as a functional part of the sealing station for sealing the packaging objects accommodated therein and may also guarantee that the packaging objects are reliably and precisely provided for the sealing process. Because the object carrier is actively advanced to the tool upper part, a stroke movement of the tool upper part may not be required. The fact that the loose object carrier has a comparatively low weight in comparison with the tool upper part of the sealing station allows the object carrier to be moved to the desired sealing position faster and with less noise and less expenditure of energy.

The above-mentioned parallel displacement of the object carrier between the preliminary position and the sealing position may be translational, such as a vertical displacement of the object carrier between the respective positions. The object carrier may be moved between two superimposed horizontal planes, and may occupy the preliminary position when located on the lower plane and may occupy the sealing position when located on the horizontal plane arranged there above.

Another advantage of the present invention is that the loose object carrier is much more flexible in use than the plate chains described in connection with the prior art. Prior art plate chains are primarily only suitable for a single type of trays and only adapted to be used with one packaging machine, since retrofitting would be cost-intensive and time-consuming. The loose object carrier can be used in an arbitrary manner for different types of packaging machines, without the necessity of substantially adapting existing tools and transfer means.

The object carrier is also advantageous insofar that arbitrarily shaped packaging objects can be accommodated therein in a space-saving manner. Known conveying means configured as a plate chain do not allow this, since the tray accommodation means formed therein must be arranged in dependence upon the conveying path. This dependency does not exist in the case of the object carrier according to one embodiment of the present invention. In such an embodiment, the object carrier may also provide a substantial advantage in that packaging objects accommodated therein can be arranged such that the amount of cover film material required for sealing the packaging objects can be reduced to a considerable extent. It would, for example, be possible to arrange triangular, polygonal or arbitrarily contoured packaging objects such that they are displaced relative to one another, if necessary in an irregular mode of the arrangement, in such a way that the amount of residual film grid formed during the sealing process will be reduced, which will lead to a reduction of waste material costs.

In one embodiment, the present invention allows a movement of the object carrier to be decoupled from a movement of the conveying means, such as the feed and discharge belts, cooperating with the packaging machine. The movement of the object carrier therefore need not depend on the intermittent movements of the respective other conveying means. In such an embodiment, the production cycles can be accelerated substantially, since the conveying means need not be stopped when the object carrier is located in the sealing station.

The object carrier can also be stored in a space-saving manner, and it can easily be handled by different conveying units associated with the packaging machine, as will be explained below.

In one embodiment of the present invention, when the object carrier is, as described hereinbefore, decoupled from or shifted away from the conveying unit within the sealing station, the conveying unit will not be subjected to any mechanical loads during the sealing cycle, whereby wear phenomena on the conveying unit can be reduced.

The loose object carrier with the packaging objects accommodated therein may be conducted to the tool upper part of the sealing station in the packaging machine. As has already been mentioned hereinbefore, this may provide shorter throughput times as well as larger batch sizes and also a more flexible use of the packaging machine. Last but not least, the object carrier can also be used for reliably conveying arbitrary shapes, in particular cup-shaped packaging objects.

The loose object carrier may be adapted to be picked up and lifted into contact with the tool upper part by means of a tool lower part of the sealing station. In such an embodiment, the tool lower part may entrain the object carrier and advance it to the tool upper part, and the object carrier may be adapted to be held in position against the tool upper part by the tool lower part at the sealing position such that, for carrying out the sealing process, the packaging objects accommodated in the object carrier are excellently oriented relative to the tool upper part and a sealing tool provided therein. Lowering of the tool upper part along a predetermined stroke path may be provided, but is not necessary, since the lifting movement of the tool lower part suffices to conduct the object carrier into contact with the tool upper part.

The object carrier can be oriented for the sealing process in the packaging machine according to one embodiment of the present invention in a particularly stable and positionally accurate manner, when it is placed in between the tool upper part and the tool lower part in a "sandwichlike mode of arrangement" at the sealing position. The object carrier may here nevertheless be visible from outside, at least sectionwise. After the sealing process, the sandwiched object carrier can rapidly be decoupled from the tool upper part as well as from the tool lower part and can thus, together with the sealed packaging objects, quickly be conveyed out of the sealing area.

In an alternative embodiment, when the object carrier occupies the preliminary position it may be adapted to be accommodated in the tool lower part such that it will be surrounded or completely enclosed by the tool lower party and moved by the tool lower part to the sealing position such that the tool lower part united with the tool upper part encloses the object carrier thus making it no longer visible from outside. This would be advantageous insofar as only a single abutment plane would exist between the tool upper part and the tool lower part, whereby an air-tight enclosure of the object carrier could be established more easily when air is supplied to and evacuated from the packaging objects to be sealed in the sealing station.

The tool lower part may be movable relative to the tool upper part between a position of rest, at which the object carrier is spaced apart from the tool upper part, and a sealing position, at which the tool lower part presses the object carrier against the tool upper part. This simple sequence of movements can easily be coordinated with the conveyance of the object carriers into the packaging machine and the removal of the object carriers from the packaging machine.

According to another embodiment of the present invention, the tool lower part is configured as a lifting table, which is arranged below the tool upper part and movable relative to the tool upper part of the sealing station. The lifting table defines a sturdy basis for pressing the object carrier against the tool upper part. Making use of the lifting table, which is primarily adjustable by means of a servomotor, strong pressing forces can be applied for pressing the object carrier against the tool upper part arranged thereabove, whereby the object carrier can be enclosed between the tool upper part and the tool lower part in a stable and air-tight manner.

The lifting table may comprise a releasable cavity plate having provided therein cavities according to the shapes of the packaging objects. When the lifting table is moved upwards, the packaging objects accommodated in the object carrier can project into these cavities. The lifting table and the object carrier attached thereto thus have a compact structural shape. In addition, the releasable cavity plate can speedily be exchanged for sealing different packaging objects.

The tool upper part, the object carrier, and the tool lower part may define an air-tight sealing chamber at the sealing position. This can be accomplished by the above-described "sandwichlike" placing of the object carrier between the tool upper part and the tool lower part as well as by enclosing the object carrier between the tool upper part and the tool lower part such that it is no longer visible from outside. In the air-tight sealing chamber the packaging objects provided in the object carrier can be exposed to an arbitrary atmosphere.

An air-tight closure can be accomplished more easily when the tool upper part and/or the tool lower part is/are provided with at least one seal (possibly in the form of an annular cord seal) which is installed in a respective outer area of the tool upper part and/or the tool lower part. It is also imaginable that multiple annular cord seals are installed concentrically with one another, so as to provide an annular cord seal track in an outer area of the respective tool parts. It would thus be possible to accomplish also a certain damping effect, when the object carrier is enclosed between the tool upper part and the tool lower part, whereby a reduction of noise will be achieved.

For generating a vacuum in the air-tight sealing chamber, the tool upper part may comprise a vacuum unit. Preferably, the object carrier may comprise at least one evacuation opening that is primarily formed on an outer area of the upper part of the object carrier. When the object carrier has been docked onto the tool upper part, the evacuation opening can be in alignment with the vacuum unit. Through the evacuation opening, the vacuum can be generated down to the tool lower part, where it exists between the surface of the tool lower part and the lower side of the upper part of the object carrier. On the lower side of the upper part of the object carrier at least one evacuation inlet may be formed that transmits the vacuum into a channel system, which may be integrated in the upper part of the object carrier and by means of which the vacuum can be generated up to the respective boundary areas of the packaging object accommodation means. It follows that the vacuum introduced through the tool upper part may be transferred within the air-tight sealing chamber through the evacuation opening of the upper part of the object carrier to the tool lower part, where it can be introduced in the evacuation inlet provided on the lower side of the upper part of the object carrier and distributed up to the boundary areas of the respective packaging object accommodation means through the channel system connected thereto.

The tool lower part may be provided with a gas flushing unit for flushing the packaging objects with gas. The gas flushing unit may comprise at least one gas flushing opening, which can be provided in the tool lower part and adapted to be aligned with at least one gas flushing inlet, which can be formed in the upper part of the object carrier, when the tool lower part receives the object carrier therein for lifting it to the tool upper part. The gas flushing inlet conducts the gas into a channel system that may be provided in the upper part of the object carrier. The channel system may either be specially provided for the purpose of gas flushing or it may be the channel system mentioned hereinbefore in connection with evacuation and being used for conducting the gas up to and into the boundary areas of the packaging object accommodation means for gas flushing the packaging objects.

The upper part of the object carrier may comprise an insertion plate which can be releasably fixed in position in an insertion depression formed on the upper side of said upper part, so as to define the above-mentioned channel system therebetween. The channel system can thus easily be adapted and cleaned.

According to a preferred embodiment, the tool upper part of the sealing station and the upper part of the object carrier can be moved into contact with each other in a centered manner. This allows the object carrier to be moved into contact with the tool upper part with high precision and with high speed. To this end, the surface of the upper part of the object carrier facing the tool upper part may have formed therein at least one centering hole, and the surface of the tool upper part facing the object carrier may have formed therein at least one complementary centering pin, which can be inserted into the respective centering hole. A particularly reliable insertion of the centering pin into the centering hole will be possible when the centering hole and/or the centering pin is/are provided with a conical portion for accurately orienting the upper part of the object carrier relative to the tool upper part.

According to a further embodiment, at least one further centering pin may also be provided in the tool lower part of the sealing station, the centering pin entering a centering hole formed in a lower side of the upper part facing the tool lower part, so as to receive the object carrier therein in an accurately positioned manner and shift it to the sealing position. In such an embodiment, a conical portion on the centering pin and/or in the centering hole could ensure improved coupling of the tool lower part to the object carrier.

In one embodiment of the present invention the conveying unit may comprise, when seen in the conveying direction, two drive belts laterally next to the sealing station for conveying the object carrier into the sealing station and for conveying the object carrier out of the sealing station. The drive belts may be displaceable in synchronism and they may overlap, at least sectionwise, with a feed belt disposed upstream of the packaging machine as well as with a discharge belt disposed downstream of the packaging machine, so that they can be used for collecting at least one object carrier from the feed belt and for transferring at least one object carrier to the discharge belt. The two drive belts, which may extend substantially parallel to one another, constitute a cost-efficient variant for making the object carriers first available to the packaging machine for the purpose of sealing and removing them from the packaging machine afterwards.

According to a preferred embodiment, the two drive belts are adapted to be pressed against the object carrier for the purpose of conveying the same. Making use of the pressing forces applied by the drive belts and acting on the object carrier, the latter can reliably and accurately be moved to a preliminary position in the sealing station of the packaging machine. The two drive belts can pick up the object carrier, possibly by means of form fit and/or force fit engagement therewith so as to reliably convey the same.

According to another embodiment, the two drive belts are vertically adjustable, preferably by means of a servomotor, for picking up at least one object carrier from the feed belt of the sealing station. The two drive belts can here be moved upwards from a waiting position, at which they are positioned below the conveying plane of the feed belt, so as to lift an object carrier, which has arrived at the front end of the feed belt, from the feed belt, the object carrier being then conveyed by means of the drive belts into the sealing station on a conveying plane elevated relative to the feed belt conveying plane. This would be especially advantageous insofar as the feed belt could continue to run independently of the two drive belts.

As an alternative to the feed belts that can be pressed against the object carrier or that are vertically adjustable, the conveying unit may comprise a gripper unit, in particular a gripper unit that is displaceable by means of a servomotor, for conveying the object carrier into the sealing station and for conveying the object carrier out of the sealing station. Such a gripper unit may operate according to the principle of the gripper described in DE 10 2008 030 510 A1, and in addition, the gripper unit according to the present invention may be configured for conveying respective object carriers and not for merely conveying the packaging objects into the sealing station. The use of a gripper unit provided for conveying the object carrier into and out of the sealing station in the case of the present invention would have the advantage that, in comparison with the above-described drive belts, it would allow higher accelerations of the object carrier, whereby production cycle periods can be reduced.

According to one embodiment of the present invention, the sealing station has provided therein a guide frame on which the object carrier can be positioned preliminarily relative to the tool upper part. This guide frame can position the object carrier such that it can be picked up by means of the gripper unit. When a conveying unit comprising the above-described drive belts is used, the guide frame is not necessary, since the object carrier can be picked up by the tool lower part directly from the two drive belts for conducting the object carrier to the tool upper part. Nevertheless, the placement of the object carrier on the guide frame ensures a positionally accurate orientation of the object carrier relative to the tool lower part, so that picking the object carrier up from said guide frame will be extremely easy.

For allowing the object carrier, in particular the upper part of the object carrier, to form a stable tool assembly together with the tool upper part and the tool lower part of the sealing station, it may be expedient to configure the upper part as a metallic plate, especially a plate produced from stainless steel, which can improve the hygienic standard, or from aluminum, whereby a reduction of weight of the object carrier can be accomplished. The property of a reduced object carrier weight may be very important in the case of the present invention, and also outside of the packaging machine, such as with regard to return conveyance and procurement as well as storing of the object carriers, since the respective object carrier can thus be conveyed and manipulated more easily.

According to a preferred embodiment, the object carrier comprises a lower part on which the upper part is rigidly fixed in position. The lower part offers special advantages with regards to handling as well as conveyance of the object carrier.

An additional optimization of weight of the object carrier can be achieved by producing the lower part, at least partially, from plastic material, preferably from PE material. Plastic material, in particular PE material, can be cleaned exceptionally easily and prevents bacterial cultures from settling thereon, so that it is suitable for use in the food industry.

The above-described, material-dependent optimization of weight can be improved further by providing the lower part with first and second rails having the upper part fixed thereto. Since the respective rails have a low mass, the total weight of the object carrier can be minimized. In addition, the two rails occupy a comparatively small spatial volume, a circumstance that may be of advantage when the object carrier is stored. In particular, the object carrier can, making use of the rails, be deposited conveniently on the conveyor belts, and it can also easily be removed therefrom, either in an automated process or by means of human force.

The two rails may preferably be fixed to opposed sides of the upper part of the object carrier and oriented such that they are substantially parallel to one another. The object carrier thus rests stably on the conveyor belts. When the object carrier is being conveyed, the two rails may be oriented transversely to the conveying direction on the object carrier.

According to an advantageous embodiment, the rails each comprise a guide slot by means of which the object carrier can be conducted along a guide, in particular along a guide plate arranged alongside the conveyor belts. The guide slots may assist the operator in orienting the object carrier correctly on the conveyor belts, and the placement of the guide slots on the guide plate may prevent the object carrier from falling off the conveyor belt during conveyance.

Preferably, the two rails each comprise at least one aligning element for aligning two successive object carriers relative to one another. Like the guide slot, the aligning element can enhance the reliability of object carrier conveyance. The aligning element may, for example, be configured in a wave shape as a countertoothing so as to engage the complementarily toothed aligning element of an object carrier that has moved into contact with the object carrier in question. The respective aligning elements preferably project laterally beyond the upper part so that the object carrier can be pushed across a conveyor belt gap by an object carrier docked thereonto from behind, the conveyor belt gap existing between two adjacent conveyor belt sections.

According to a further embodiment of the present invention, the lower part may comprise a lifting element which is movably coupled to the lower part and adapted to be moved relative to the upper part such that the packaging objects accommodated in the upper part can be lifted for the purpose of removal. The lifting element may, for example, be pretensioned in the lower part. Alternatively to the lifting element integrated in the lower part, the packaging objects accommodated in the object carrier may, for the purpose of removal, also be lifted out of the object carrier by means of a take-off station, which may be specially provided for this purpose and arranged downstream of the packaging machine. This could reduce the manufacturing costs of the object carrier.

The object carrier may comprise an upper part with a plurality of packaging object accommodation means for holding packaging objects which are to be sealed in the packaging machine as well as a lower part having coupled thereto a vertically adjustable lifting element, the lifting element being positionable at least between a position of rest and a removal position within the lower part. At the position of rest, the packaging objects are held for sealing in the respective packaging object accommodation means and, at the removal position, the packaging objects are lifted through the lifting element such that they can be removed from the packaging object accommodation means. This kind of object carrier can be used in combination with different packaging machines for feeding to these machines packaging objects for the purpose of sealing. The use of this kind of object carrier may allow easy removal of the packaging objects from the object carrier after they have been sealed in the packaging machine.

In order to allow the object carrier to be placed on the guide frame above the tool lower part in a positionally accurate manner so that it can be picked up by the tool lower part, the two rails may each comprise a lateral guide according to a preferred embodiment.

Preferably, the respective rails are connected to at least one leg element, which fastens the rails to the upper part of the object carrier. For conducting the object carrier through the packaging machine, the conveying unit may take hold of the object carrier, in particular at the leg element thereof. In order to avoid wear phenomena on the leg element, the leg element may preferably be produced from PA material (polyamide), for example, PA6 material (polycaprolactam). This material has a high degree of hardness and is therefore particularly wear resistant. In order to allow the object carrier to be reliably taken hold of at the leg element, the leg element may be configured, at least partially, as a rotationally symmetric element, and it may have the shape of a double cone. In particular it may comprise a tapering portion so that it can be taken hold of more easily, the tapering portion being adapted to have coupled thereto not only the conveying unit but also conveying means for returning the object carrier. In particular, two respective leg elements for fixing a rail may be provided on the upper part of the object carrier, the leg elements being preferably arranged at the respective corner areas of the object carrier, thus making it possible to easily grip the object carrier.

According to one embodiment, the respective rails and/or the respective leg elements are provided with notches through which the object carrier can be precentered on the tool lower part when it is being picked up by the tool lower part. Due to the fact that, when the object carrier is being picked up by the tool lower part, it is already supported thereon in a precentered manner, also the centering holes and centering pins described hereinbefore in connection with the tool upper part and the upper part of the object carrier can optimally be oriented relative to one another in advance. The object carrier can thus be moved into contact with the tool lower part and the tool upper part in the best possible way.

The lower part may comprise at least one stacking projection by means of which another object carrier can be positioned on the object carrier in question in a skid-proof manner. This also allows a plurality of object carriers to be safely stacked one on top of the other.

In addition, a transponder, such as an RFID transponder, may be provided in at least one of the two rails, for storing information thereon, for example, object carrier-specific parameters. These parameters may comprise sealing characteristics so as to unequivocally associate the object carrier with a predetermined sealing process and a specific packaging machine, respectively.

Up to now, the present invention and the advantageous embodiments thereof have mostly been described in connection with only one object carrier, which can be adapted to be fed separately to the sealing station for sealing a plurality of packaging objects accommodated therein. This, however, is in no way intended to restrict the present invention, since, according to a further embodiment, at least two object carriers can be accommodated in the sealing station during a sealing cycle. Conveying the plurality of object carriers into the sealing station as well as conveying the plurality of object carriers out of the sealing station can take place in succession or simultaneously. For simultaneously conveying a plurality of object carriers into the sealing station, a collecting station, which may comprise a plurality of feed belts arranged side-by-side, can be provided upstream of the packaging machine, from where a plurality of the above-described conveying units simultaneously remove several of the object carriers provided, so as to feed them to the sealing station. Optionally, the plurality of object carriers may be removed successively from the feed belt and provided to the sealing station for a sealing cycle.

The packaging machine according to the present invention is excellently suitable for integration in a packaging system, in particular a packaging system having the shape of a closed ring or a packaging system having an arbitrarily curved shape along the conveying path. Such a packaging system may, in addition to the above-described packaging machine according to one embodiment of the present invention, also provide a take-off station for removing fully sealed packaging objects as well as an infeed station for charging the object carrier with a plurality of unsealed packaging objects. For removing the packaging objects from an object carrier, the latter may be positioned above the take-off station, and a vertically adjustable take-off plate, which may be movable to a position between the rails of the lower part, being then used for lifting the packaging objects which may be disposed thereabove and which project through the upper part, so as to remove them from the object carrier. The packaging objects may then be removed from the object carrier manually or in an automated process.

In addition, the packaging system may, according to another embodiment, provide a return unit by means of which the empty object carriers can be conveyed back the infeed station.

The return unit may especially provide conveying means receiving the object carriers thereon for return conveyance such that they can be conveyed in a condition in which they may be tilted by substantially 90° C. relative to their normal orientation during conveyance. Without occupying much space, the object carriers can thus be conveyed back to the infeed station for charging. For conveying the object carriers, the return unit may comprise an endless belt onto which the tapering portion of the leg element or the rail can be placed. Instead of the belt, a rod-type conveying means or a cleated chain may be used.

The return unit may extend alongside the packaging machine in close proximity therewith, but it may also extend, at least sectionwise, below a plane of the packaging machine, in particular a plane of the sealing station provided in the packaging machine. As an additional variant it would also be imaginable to arrange the return unit above the packaging machine, so that the tilted object carriers could be returned to the infeed station above the packaging machine. The room available in high production halls could thus be utilized more effectively.

The infeed station may comprise preferably a centering unit above which at least one object carrier can be positioned. Making use of the centering unit, the packaging objects can be centered in the upper part of the object carrier. For centering each individual packaging object, the centering unit preferably comprises a respective liftable and lowerable pin that is capable of gripping through the respective packaging object accommodation means formed in the upper part of the object carrier, so as to grip the packaging objects provided thereabove, such as by a robot, from below at the bottom of the packaging object in question. For improved centering of the packaging objects, the respective pins each comprise horizontally displaceable jaws by means of which the packaging objects can be fixed and centered on the pins. For the purpose of centering, the above-mentioned jaws may be adjustable pneumatically and in synchronism.

When the packaging objects have been centered, the respective pins preferably move downwards for pulling the packaging objects into the accommodation means of the upper part of the object carrier. When this has been done, the jaws may be opened by pulling them back inwards, so as to release the respective packaging objects. The charged object carriers can then be conveyed to the packaging machine.

According to another embodiment on the present invention, the centering unit comprises a vertically adjustable pin with movable jaws for gripping a packaging object, the pin being positionable relative to the bottom of the packaging object such that an extension of the movable jaws will fix the bottom of the packaging object and center it via the pin. In particular, the above-described object carriers can be positioned above the centering unit such that the respective pins of the centering unit can move through the packaging object accommodation means for gripping packaging objects disposed thereabove and centering them relative to the pin, so that, while moving downwards, the pins will pull the respective packaging objects into the packaging object accommodation means provided for them in centered orientation therewith. The packaging objects can thus be stored correctly in the packaging object accommodation means.

According to another embodiment of the present invention, at least one robot may be provided in the packaging system for charging the object carriers with packaging objects and for removing the latter from the object carriers. In particular, the packaging objects removed from the object carrier by means of the robot may be supplied to a labelling or a packaging station, where the sealed packaging objects are palletized or packed in cardboard boxes.

In addition, the packaging system may comprise at least one detection unit along the conveying path, by means of which the object carrier and/or the packaging objects within the object carrier are detectable. By means of such a detection unit it would especially be possible to find out whether the packaging objects occupy the correct position within the object carrier. Such a detection unit may comprise, for example, one or a plurality of ultrasonic, laser and/or infrared sensors, by means of which the object carriers as well as the packaging objects accommodated therein can be detected.

A particularly high hygienic standard can be accomplished when the packaging system includes a washing station for cleaning the object carriers therein. The washing station may be positioned along the return unit.

The present invention also relates to a method of sealing a plurality of packaging objects, wherein a loose object carrier charged with a plurality of packaging objects may be positioned at a preliminary position within a sealing station relative to a tool upper part of the sealing station, and wherein the method is characterized in that the loose object carrier may be moved from a preliminary position to a sealing position at which it is moved into contact with the tool upper part of the sealing station, the sealing position being displaced in parallel relative to the preliminary position. The loose object carrier can be configured or retrofitted for conveying different packaging objects, so that, if at all, only minor adaptations will have to be made at the packaging machine itself in the case of a change of products.

The object carrier can be advanced to the tool upper part in a particularly reliable manner in that it may be picked up by a tool lower part in the sealing station and lifted into contact with the tool upper part by the tool lower part. In particular, the tool lower part can pick up the object carrier and press it against the tool upper part such that the object carrier is jammed in between the tool lower part and the tool upper part such that it is still visible and defines together therewith an air-tight sealing chamber. The air-tight sealing chamber is excellently suitable for generating a predetermined atmosphere, such as by creating a vacuum in and/or applying a substitute gas to the sealing chamber. In this respect, the air-tight sealing chamber may, for example, be evacuated from the tool upper part and flushed with a gas from the tool lower part. The vacuum introduced from the tool upper part may propagate through at least one evacuation opening, which may be provided in the boundary area of the upper part of the object carrier, down to the tool lower part, where it may be applied to the lower side of the upper part of the object carrier and conducted up to the respective boundary areas of the packaging objects by means of a channel system provided in the upper part of the object carrier, so as to evacuate the packaging objects. On the other hand, a protective gas (e.g. an inert gas), which may be introduced from the tool lower part into the air-tight sealing chamber, can spread up to the packaging objects through at least one gas-flushing opening provided in the upper part of the object carrier.

According to a preferred embodiment of the present invention, not only one, but at least two object carriers are accommodated in the sealing station during a sealing cycle, so that larger batch sizes can be produced.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
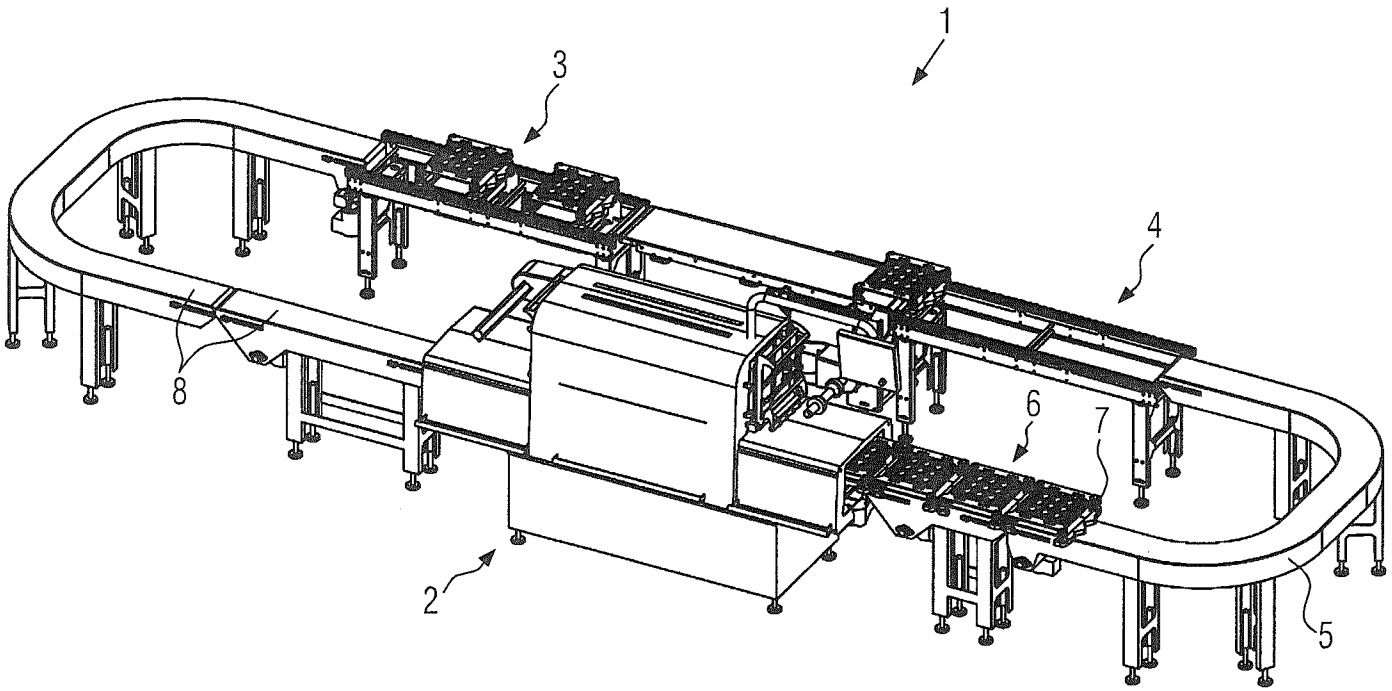
FIG. 1 is a perspective view of a packaging system including a packaging machine according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practice. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a packaging system 1 having the shape of a closed ring and comprising a packaging machine 2 according to one embodiment of the present invention, a take-off station 3 and an infeed station 4. The packaging machine 2 may have successively fed thereto object carriers 6 on a feed belt 5 for a sealing process. The respective object carriers 6 may accommodate therein packaging objects 7, such as trays to be closed. The packaging objects 7 may have an arbitrary container shape for accommodating therein various items such as solid or liquid food products or medical products. From the packaging machine 2 a discharge belt 8 may lead to the take-off station 3. The object carriers 6, which may be discharged from the packaging machine 2 with fully sealed packaging objects 7, can be conveyed on the discharge belt 8 to the take-off station 3 for emptying the object carriers 6.

Figure 2:
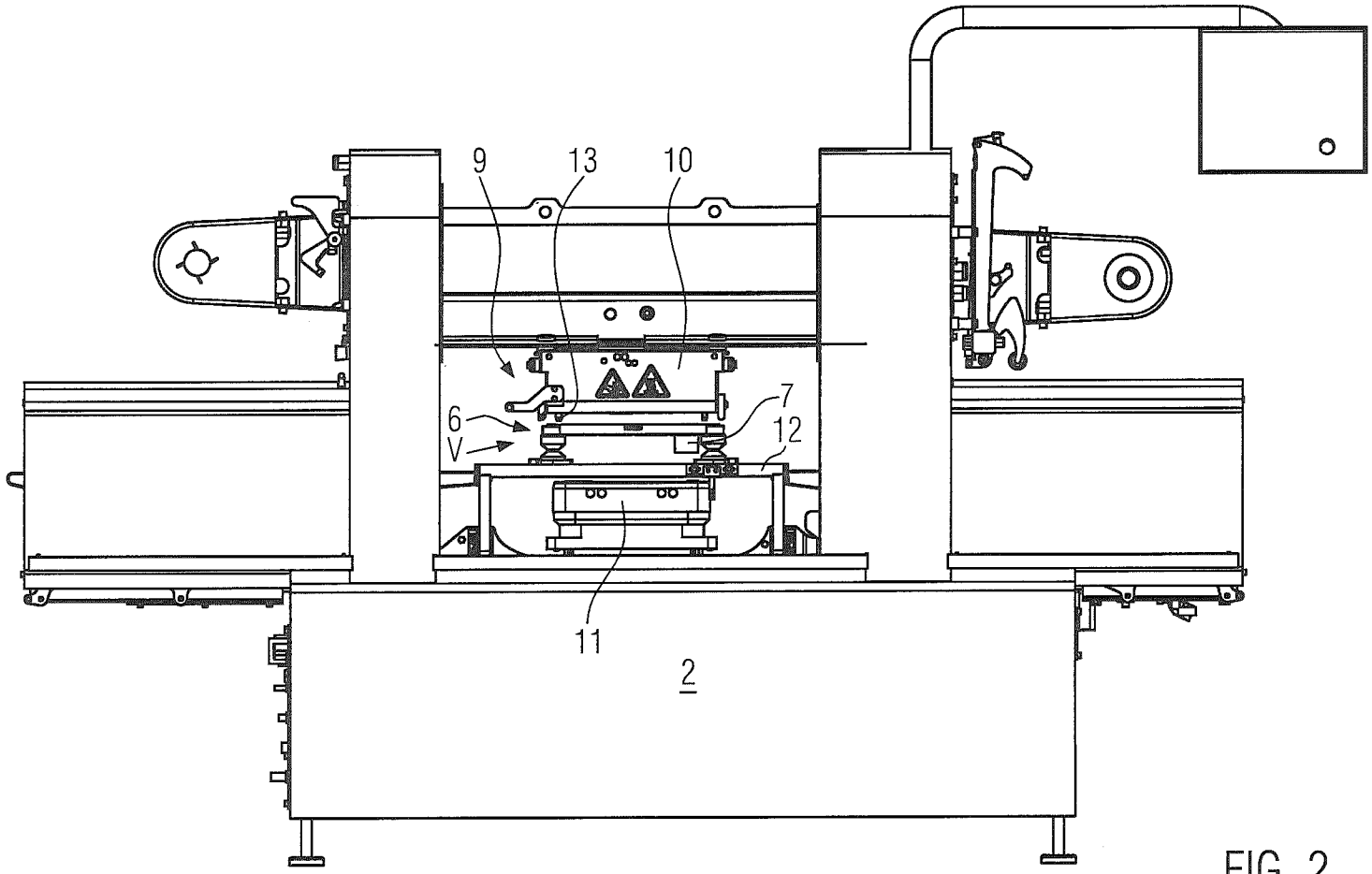
FIG. 2 is a side view of a packaging machine with a preliminarily positioned object carrier in the sealing station according to one embodiment of the present invention.

FIG. 2 shows the packaging machine 2 according to one embodiment of the present invention comprising a sealing station 9. The sealing station 9 may comprise a tool upper part 10 as well as a tool lower part 11. Between the tool upper part 10 and the tool lower part 11, the object carrier 6 may be preliminarily positioned on a guide frame 12. Two centering pins 13 may project downwards from the tool upper part 10. As will be described later on, these centering pins 13 can engage centering openings of the object carrier 6, when the latter abuts on the tool upper part 10. In FIG. 2, the object carrier 6 occupies a preliminary position V on the guide frame 12. The tool lower part 11 may occupy a position of rest according to FIG. 2, at which the object carrier 6 is still spaced apart from the tool upper part 10 and the object carrier 6 has not yet been received in the tool lower part 11.

Figure 3:
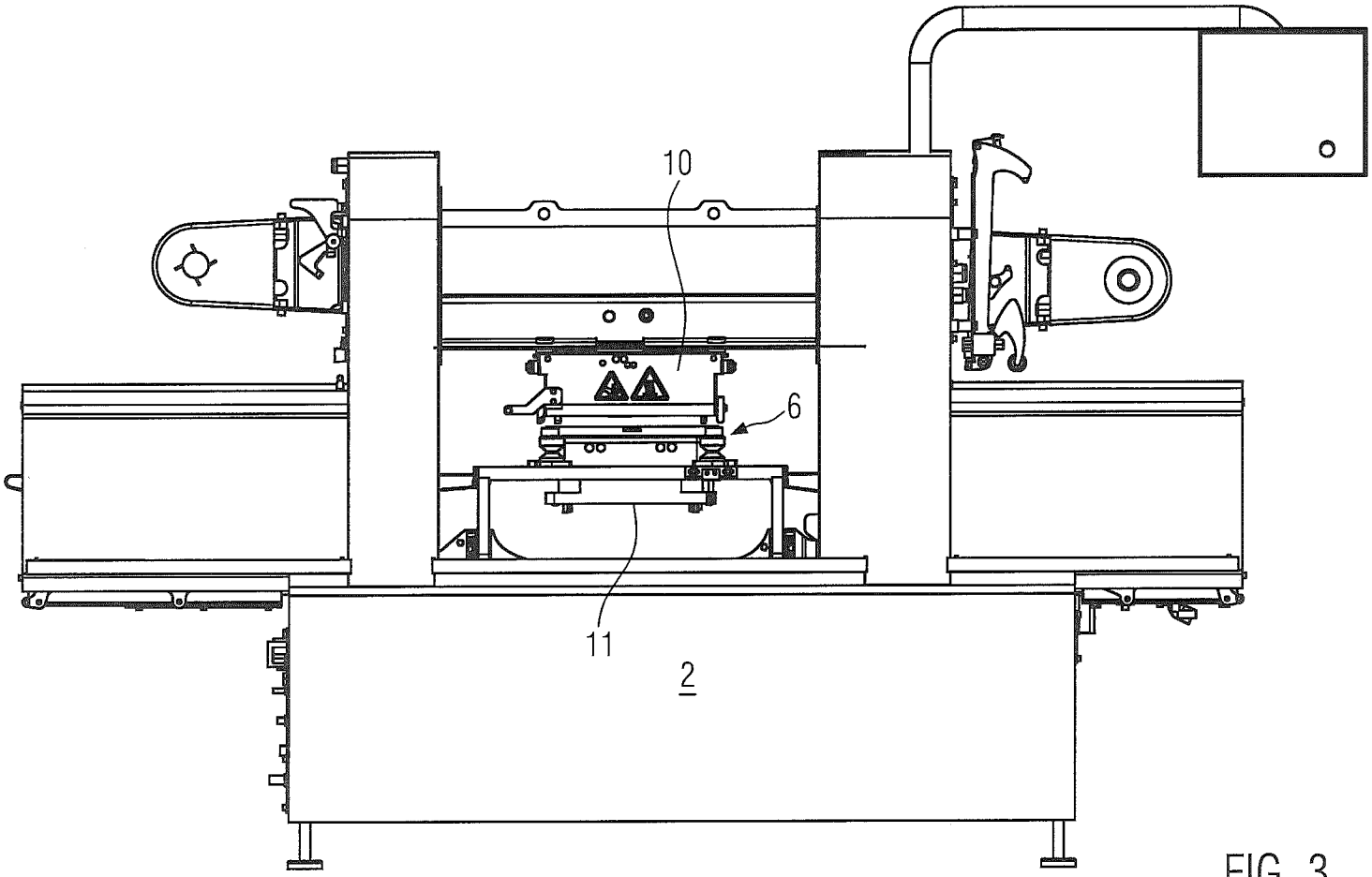
FIG. 3 is a side view of a packaging machine with a tool lower part of a sealing station moved upwards and into contact with an object carrier according to one embodiment of the present invention.

FIG. 3 shows the packaging machine 2 with the tool lower part 11 having now moved into contact with the object carrier 6. As can easily be seen in FIG. 3, the tool lower part 11 may dock from below onto a lower surface of the object carrier 6 facing the tool lower part 11 so as to lift the object carrier 6 off from the guide frame 12 in the direction of the tool upper part 10. As shown in FIG. 3, the object carrier 6 may still be spaced apart from the tool upper part 10 and may be then pressed against the tool upper part 10 by continuing the upward movement of the tool lower part 11.

Figure 4:
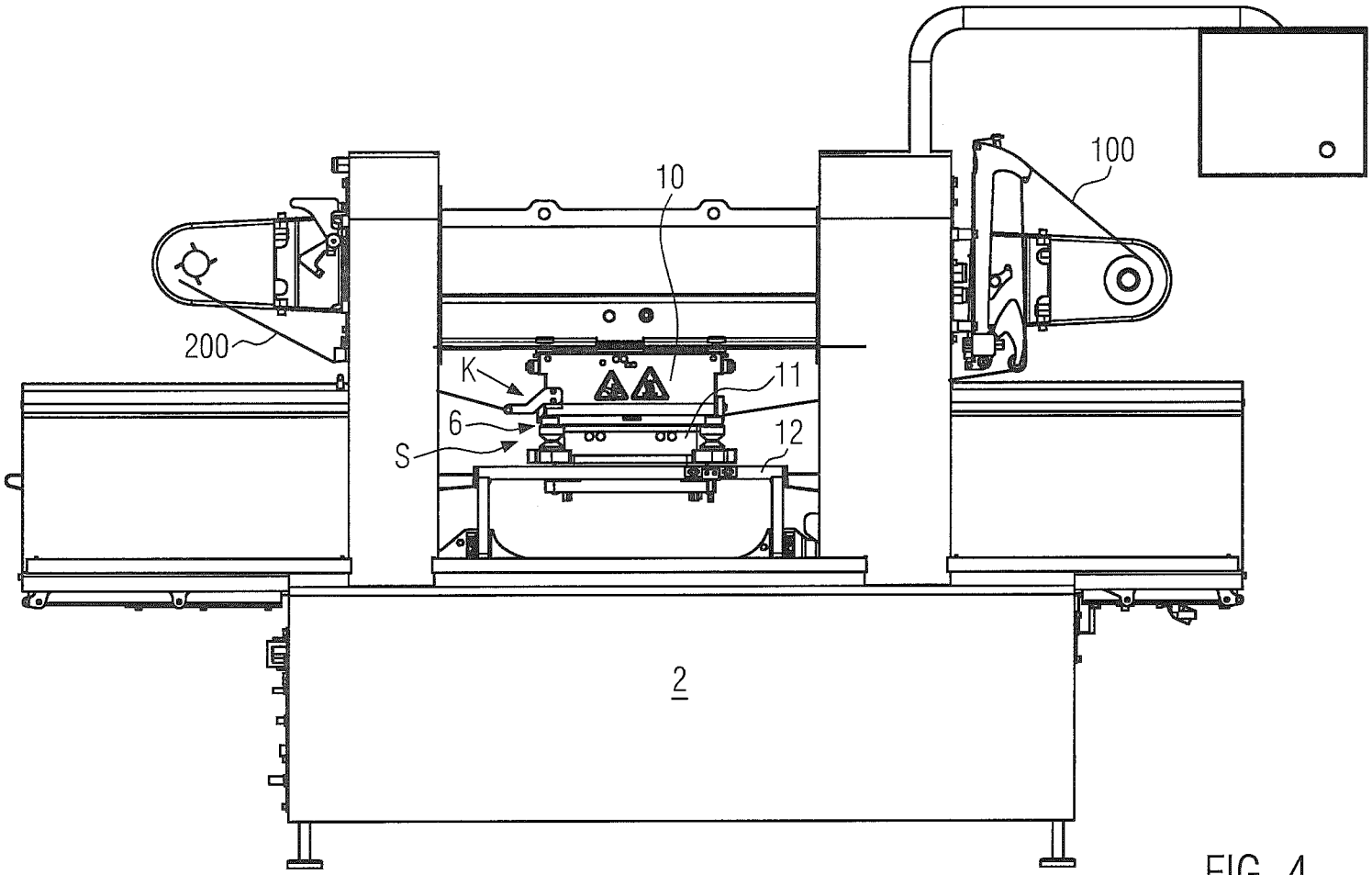
FIG. 4 is a side view of a packaging machine with a sealing station at a sealing position according to one embodiment of the present invention.

As shown in FIG. 4, the object carrier 6 may be forced upwards against the tool upper part 10 by the continued lifting movement of the tool lower part 11. In the course of this process, the object carrier 6 may be moved away from the guide frame 12. The object carrier 6, now decoupled from the guide frame 12, may then be jammed in between the tool upper part 10 and the tool lower part 11 so as to define an air-tight sealing chamber K therebetween. The object carrier 6 may surround the tool lower part 11 at least partially. As shown in FIG. 4, the object carrier 6 may be positioned at a sealing position S and the tool lower part 11 at a sealing site. At the sealing position S, a cover film 100, which may be fed through the packaging machine 2, may be jammed in between the tool upper part 10 and the object carrier 6 and sealed by means of a sealing tool onto the packaging objects 7 accommodated in the object carrier. The sealing tool, which is not shown, may be positioned in the tool upper part 10 of the sealing station 9. After the sealing process, a residual film grid 200 may be conveyed out of the sealing station 9 as waste material.

FIGS. 5 to 9 show the packaging machine 2 according to one embodiment of the present invention with different variants of a conveying unit 23 by means of which the loose object carriers 6 of the sealing station 9 can be fed and by means of which the object carriers 6 can be conveyed out of the sealing station 9 after the sealing process. The conveying unit 23 comprises the conveying means which may be provided directly on the packaging machine 2 as shown in FIGS. 5-9. In addition, the conveying means provided immediately upstream of the packaging machine 2 may include the feed belt 5 and/or a gripper unit 14, and the conveying means provided immediately downstream of the packaging machine 2, may include the discharge belt 8.

Figure 5:
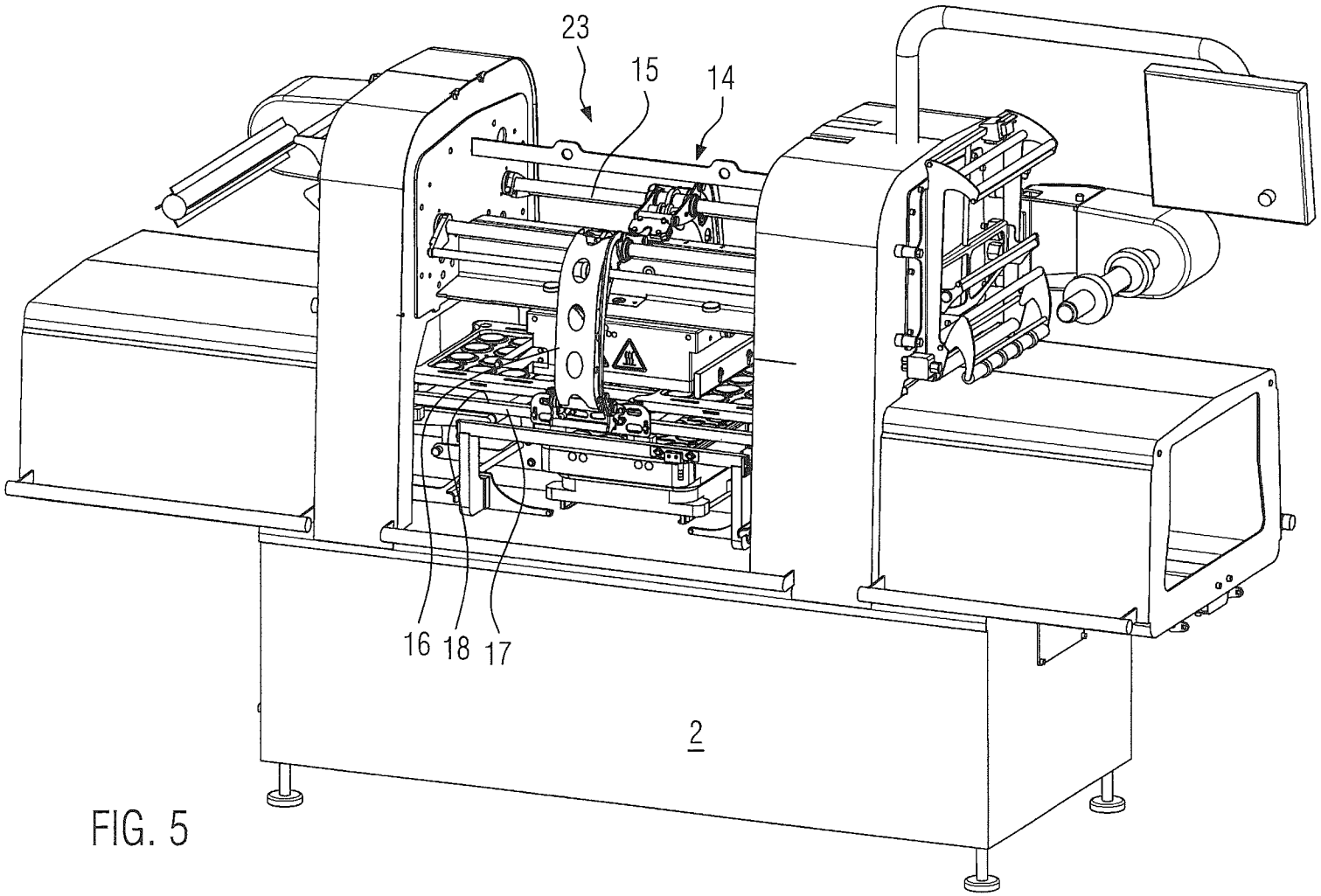
FIG. 5 is a perspective view of a packaging machine with a gripper device according to one embodiment of the present invention.

FIG. 5 shows a perspective view of the packaging machine 2 according to one embodiment of the present invention. The packaging machine 2 may comprise a gripper unit 14 with longitudinal guides 15 and gripper arms 16. The gripper arms 16 may be displaceable along the longitudinal guides 15 for conveying the object carriers 6 into and out of the sealing station 9. The gripper arms 16 may also be adjustable transversely to the conveying direction for taking hold of and releasing the object carriers 6. Each of the gripper arms 16 may comprise a respective gripper 17 provided with gripper openings 18 used for receiving therein the object carriers 6 and capable of accommodating the object carrier 6 at the corner areas thereof, in particular at leg elements thereof that will be described later on. As shown in FIG. 5, the gripper 17 may extend from the end of an object carrier 6 to the beginning of a subsequent object carrier 6, so as to allow combined gripping for simultaneously conveying a respective object carrier 6 into and another one out of the packaging machine 2.

Figure 6A:
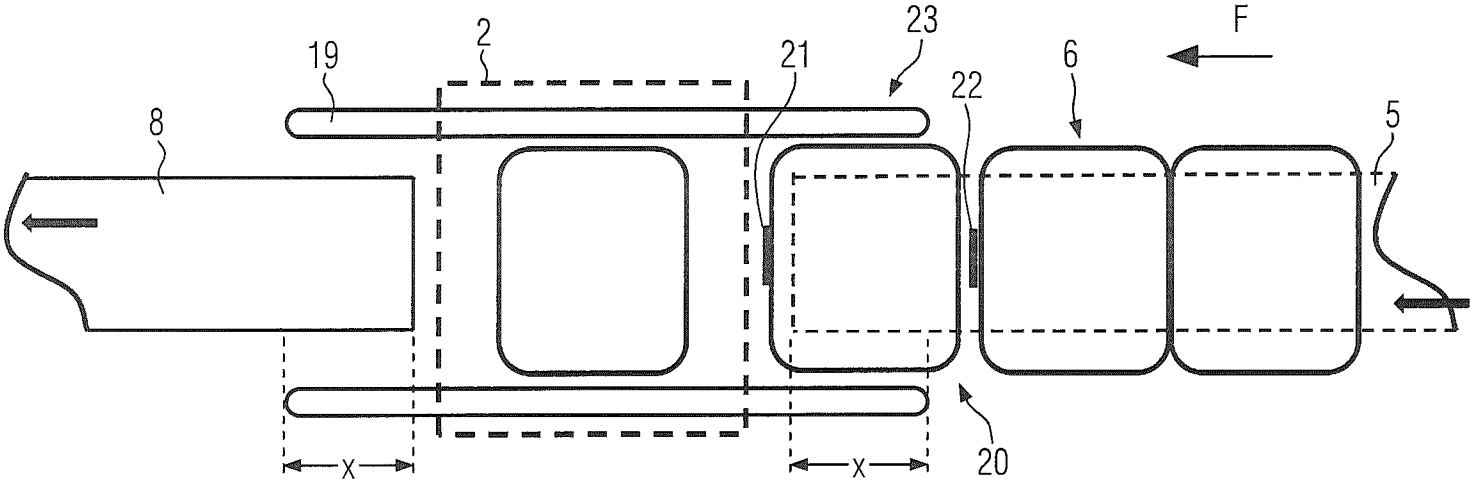
FIG. 6A is a schematic top view of a conveying unit with two drive belts alongside a sealing station at a waiting position, where the drive belts are adapted to be pressed against an object carrier according to one embodiment of the present invention.

FIG. 6A shows a schematic top view of the packaging machine 2 having fed thereto successive object carriers 6 through the feed belt 5. The discharge belt 8 may lead away from the packaging machine 2 for carrying away the object carriers 6 with the fully sealed packaging objects 7. When seen in the conveying direction F, the packaging machine 2 may have laterally associated therewith two drive belts 19. The two drive belts 19 may be oriented parallel to each other and pass through the packaging machine 2. The respective drive belts 19 may overlap a certain length X of the feed belt 5 and of the discharge belt 8, as shown in FIG. 6A. The overlap length X may substantially correspond to the length of the object carrier 6. It can thus be guaranteed that the drive belts 19 can easily collect an object carrier 6 from the end of the feed belt 5 so as to convey it into the packaging machine 2. Likewise, the drive belts 19 can thus convey an object carrier 6 out of the packaging machine 2 and deposit it on the discharge belt 8.

FIG. 6A also shows a stopper unit 20. The stopper unit 20 may comprise a first stopper 21 arranged at the end of the feed belt 5. The first stopper 21 may prevent the object carrier 6 waiting upstream of the packaging machine 2 from entering the packaging machine 2 from the feed belt 5 in an uncontrolled manner. A second stopper 22, which may also belong to the stopper unit 20, may be arranged behind the object carrier 6 waiting upstream of the packaging machine 2. The second stopper 22 may prevent an additional object carrier 6, disposed behind a front object carrier 6, from knocking against the front object carrier 6 when it is collected by the drive belts 19. Due to the stopper unit 20, the feed belt 5 can run continuously for accumulating object carriers 6 upstream of the packaging machine 2. The stopper unit 20 may ensure unobstructed conveyance of the object carriers 6 into the packaging machine 2.

Figure 6B:
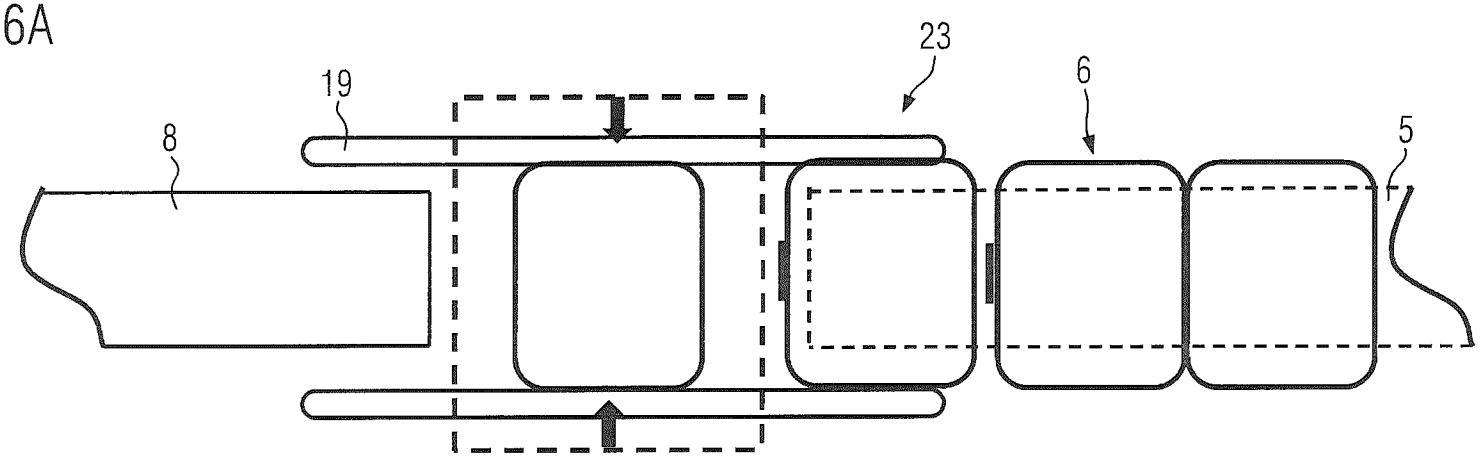
FIG. 6B is a schematic top view of the conveying unit according to FIG. 6A illustrating the drive belts at a position at which they have been moved towards each other.

FIG. 6B shows how the two drive belts 19 may be pressed against the object carrier 6, which is already positioned in the sealing station 9 (according to the embodiment shown in FIG. 6B), as well as against the object carrier 6 waiting on the feed belt 5, for the purpose of conveying said object carriers 6.

Figure 6C:
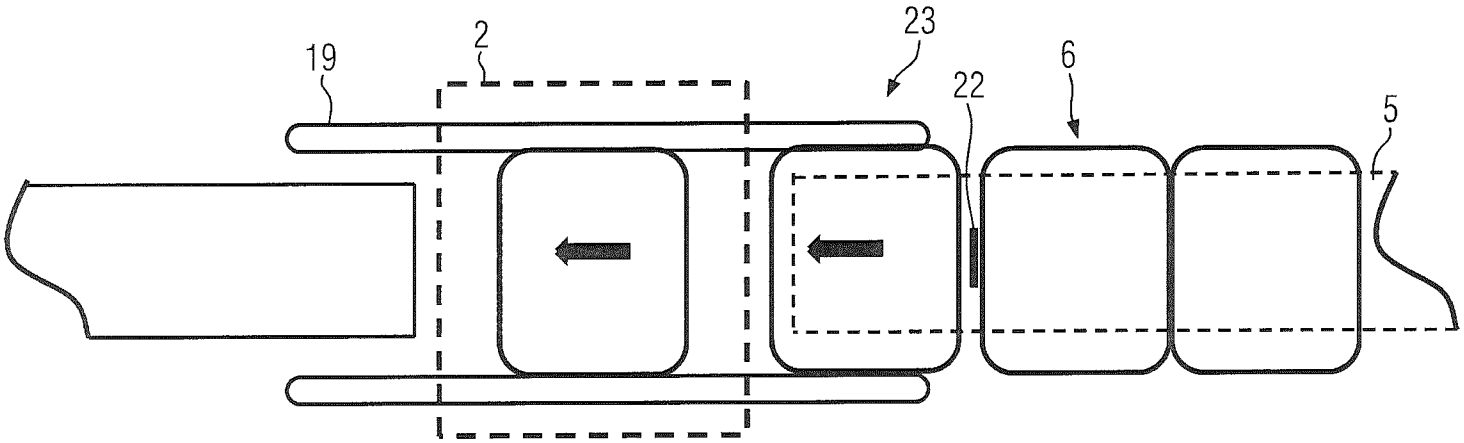
FIG. 6C is a schematic top view of the conveying unit according to FIG. 6A illustrating the drive belts in forward movement.

Conveyance of the object carrier 6 out of the sealing station 9 may begin in the schematic representation shown in FIG. 6C. At the moment in time of FIG. 6C, the sealing process in the sealing station 9 of the packaging machine 2 has been finished and the object carrier 6 can be discharged according to one embodiment of the present invention. In order to allow this object carrier 6 to be followed simultaneously by another one, the first stopper 21 may open and release the object carrier 6 waiting at the end of the feed belt. In FIG. 6C, the arrows on the leading two object carriers 6 indicate that the object carrier 6 disposed in the packaging machine 2 and the object carrier 6 waiting at the end of the feed belt 5 are conveyed simultaneously, the first object carrier 6 being conveyed out of the packaging machine 2 and the subsequent object carrier 6 being conveyed into the packaging machine 2.

Figure 6D:
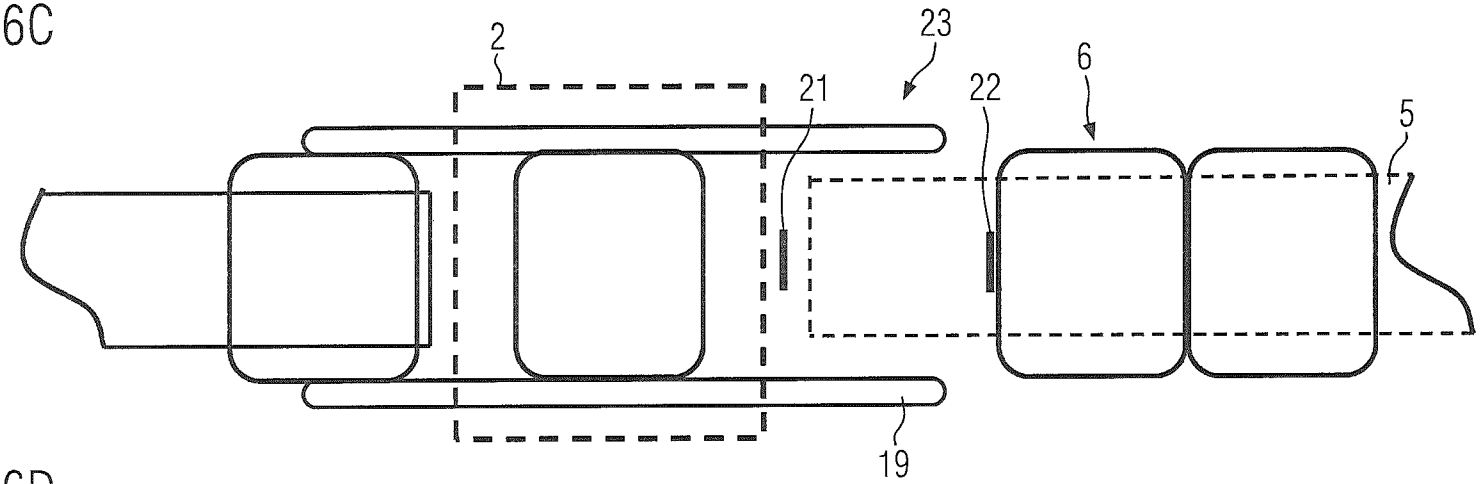
FIG. 6D is a schematic top view of the conveying unit according to FIG. 6A illustrating how respective object carriers are simultaneously conveyed out of and into the packaging machine by means of the drive belts.

In FIG. 6D, the object carrier 6 that was initially disposed in the packaging machine 2 has been deposited on the discharge belt 8. The object carrier 6 waiting at the end of the feed belt 5 in FIG. 6A to 6C has now arrived in the packaging machine 2. In order to allow another object carrier 6 to follow up on the feed belt 5, the first stopper 21 may now be activated.

Figure 6E:
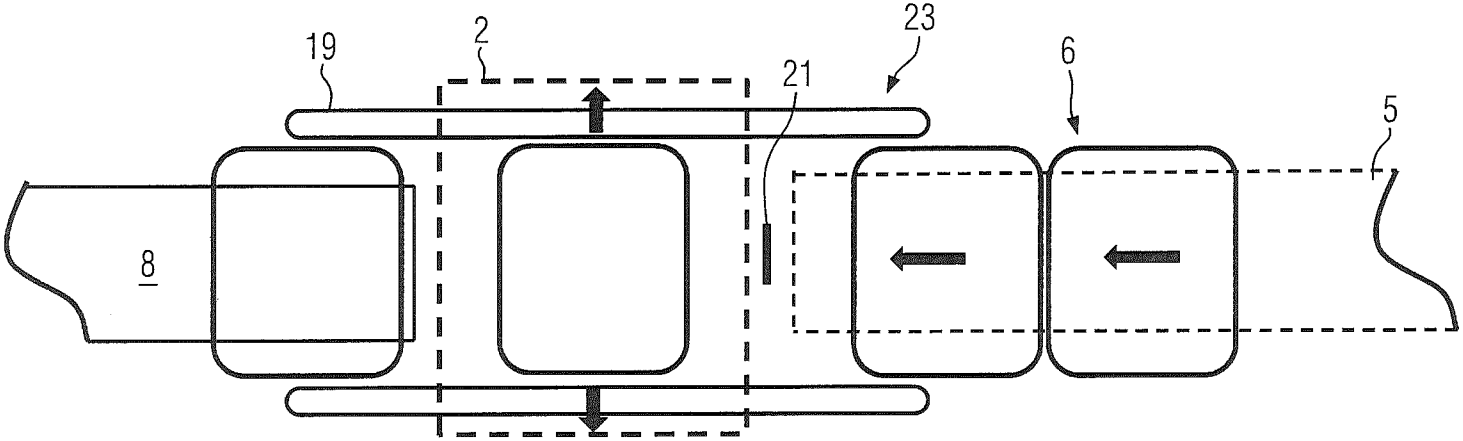
FIG. 6E is a schematic top view of the conveying unit according to FIG. 6A illustrating how the drive belts are moved back to the waiting position.

For initiating the sealing process, the drive belts 19 may move, according to FIG. 6E, outwards away from the object carrier 6 disposed in the sealing station 9, while the second stopper 22 may be activated simultaneously or with a time shift so that another object carrier 6 can move to the position at the end of the feed belt 5. The tool lower part 11 can pick up the held object carrier 6 directly from the drive belts 19, without the object carrier 6 being deposited first. In particular, the picking up of the object carrier 6 may be temporally coordinated such that the drive belts 19 move away in a fast-response outward movement as soon as the tool lower part 11 docks onto the object carrier 6 from below.

As soon as the sealing process for the object carrier 6 disposed in the sealing station 9 has been finished, a further object carrier 6 may be moved to the end of the feed belt 5, the object carrier 6 conveyed first being then conveyed away on the discharge belt 8. The cycle can then start again according to FIG. 6A.

Figure 7A:
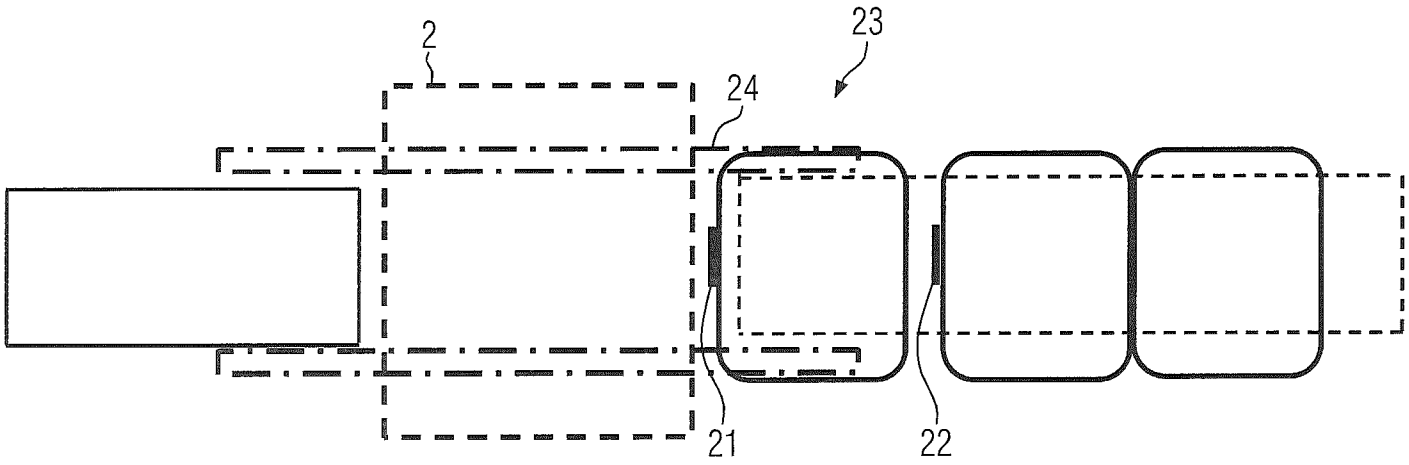
FIG. 7A is a schematic top view of two vertically adjustable drive belts alongside a sealing station as an alternative to the conveying unit according to FIG. 6A in accordance with one embodiment of the present invention.
Figure 7B:
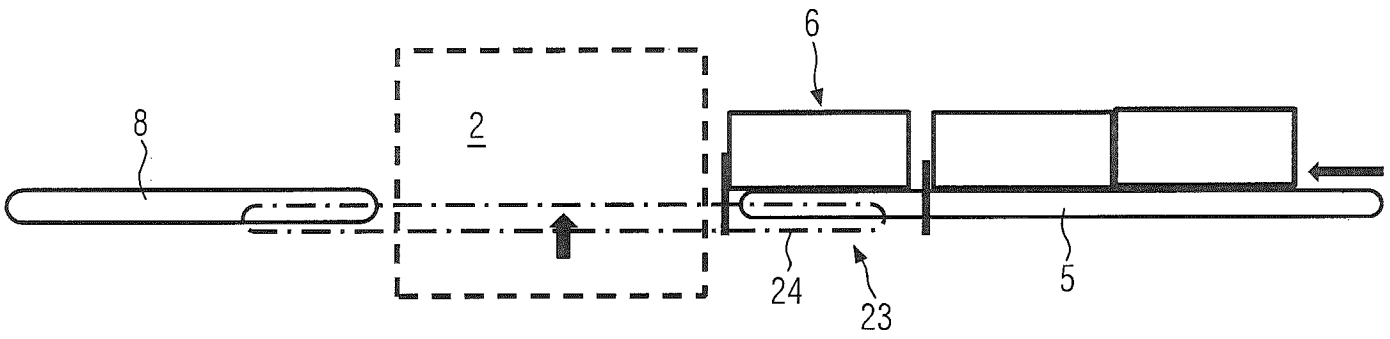
FIG. 7B is a schematic side view of the vertically adjustable drive belts according to FIG. 7A.

FIGS. 7A and 7B show an alternative to the conveying unit 23 provided with the drive belts 19 according to FIG. 6A to 6E. FIG. 7A shows the conveying unit 23 comprising two vertically adjustable drive belts 24 may be configured for conveying the object carriers 6 successively into and out of the packaging machine 2. Also the vertically adjustable drive belts 24 may overlap a certain length X of the feed belt 5 and of the discharge belt 8, so that picking up an object carrier 6 from the feed belt and transferring an object carrier 6 to the discharge belt 8 can be easily possible. At the end of the feed belt 5, an object carrier 6, which can be collected by the drive belts 24, may be positioned at the first stopper 21. In FIG. 7A the two vertically adjustable drive belts 24 occupy a height level below the feed belt 5 so that, when moving up, they can pick up the object carrier 6 positioned on said feed belt 5.

The picking up of the object carrier 6 is shown in FIG. 7B. To this end, the two vertically adjustable drive belts 24 may move from the lowered waiting position upwards for picking up the object carrier 6 positioned at the end of the feed belt 5. As soon as the object carrier 6 lies on the two drive belts 24 and has been the decoupled from the feed belt 5, the drive belts 24 may convey the object carrier 6 into the packaging machine 2, where it can be deposited on the guide frame 12 or carried by the two vertically adjustable drive belts 24 until it will be picked up by the tool lower part 11 and moved into contact with the tool upper part 10. Also the variant of the conveying unit 23 shown in FIGS. 7A and 7B allows the feed belt 5 to run continuously, thus allowing for fast follow-up of the object carriers 6 to the packaging machine 2.

Figure 8A:
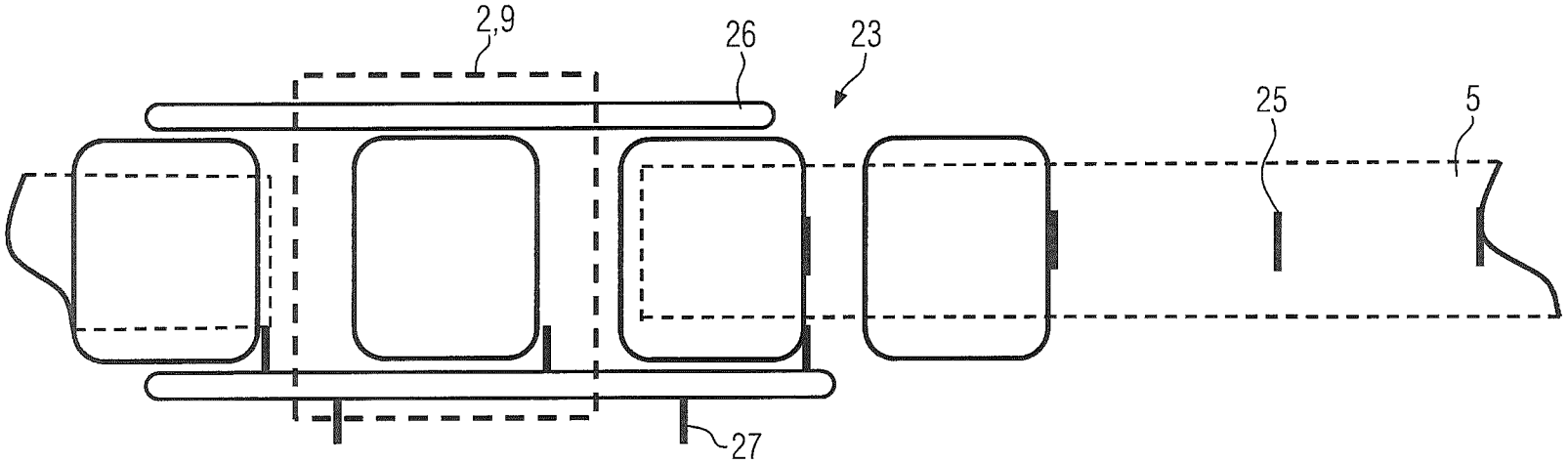
FIG. 8A is a schematic top view of alternative drive belts provided with pushers according to one embodiment of the present invention.
Figure 8B:
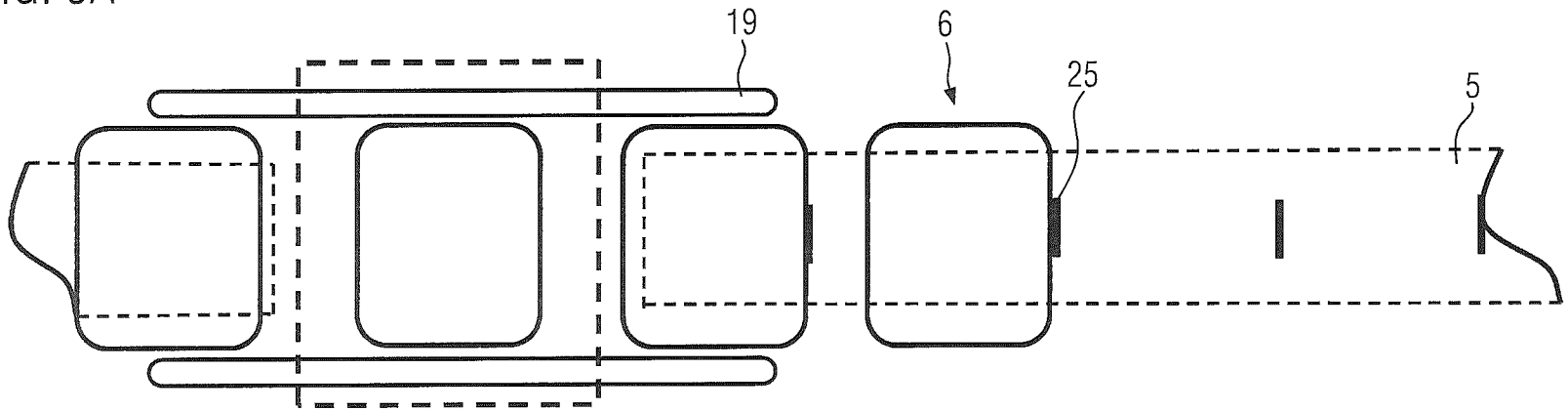
FIG. 8B is a schematic top view of a feed belt with pushers for conveying object carriers to a packaging machine according to one embodiment of the present invention.

In FIGS. 8A and 8B, a further variant of the conveying unit 23 is shown. As shown in FIG. 8A, the feed belt 5 may comprise pushers 25, which may be in the form of pusher rods. In this embodiment, the feed belt 5 runs intermittently (i.e. it is clocked like the sealing station 9). According to this embodiment, the conveying unit 23 comprises here two laterally positioned drive belts 26, the drive belt 26 shown in FIG. 8A and arranged on the left-hand side of the packaging machine 2 comprising exemplarily pick-up means 27, which collect the respective object carriers 6 from the feed belt 5 and pull them into the packaging machine 2. It would also be imaginable that, as shown in FIG. 8B, that the feed belt 5 is combined with a conveying unit 23 according to FIG. 6A to E.

Figure 9:
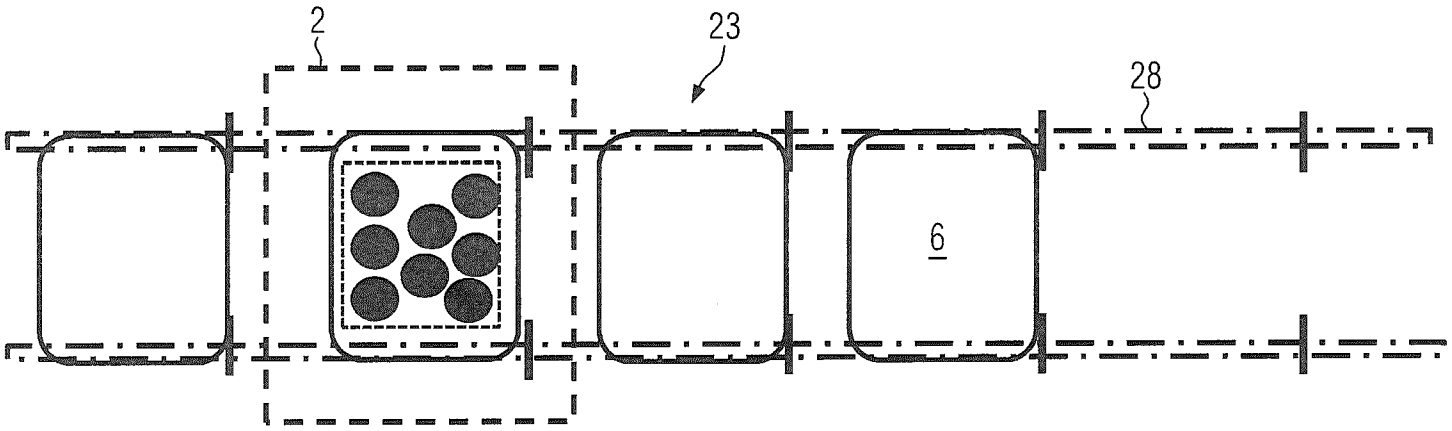
FIG. 9 is a schematic top view of object carriers being fed into a sealing station by means of cleated chains according to one embodiment of the present invention.

FIG. 9 shows another variant of the conveying unit 23. According to the embodiment shown in FIG. 9, the conveying unit 23 may comprise two cleated chains 28. Along these cleated chains 28, the object carriers 6 can be fed successively to the packaging machine 2, where the feeding may be clocked like the operation of the sealing station 9. As shown in FIG. 9, the packaging object accommodation means 30 may be arranged in an arbitrary and irregular manner so as to reduce the amount of cover film material.

Figure 10:
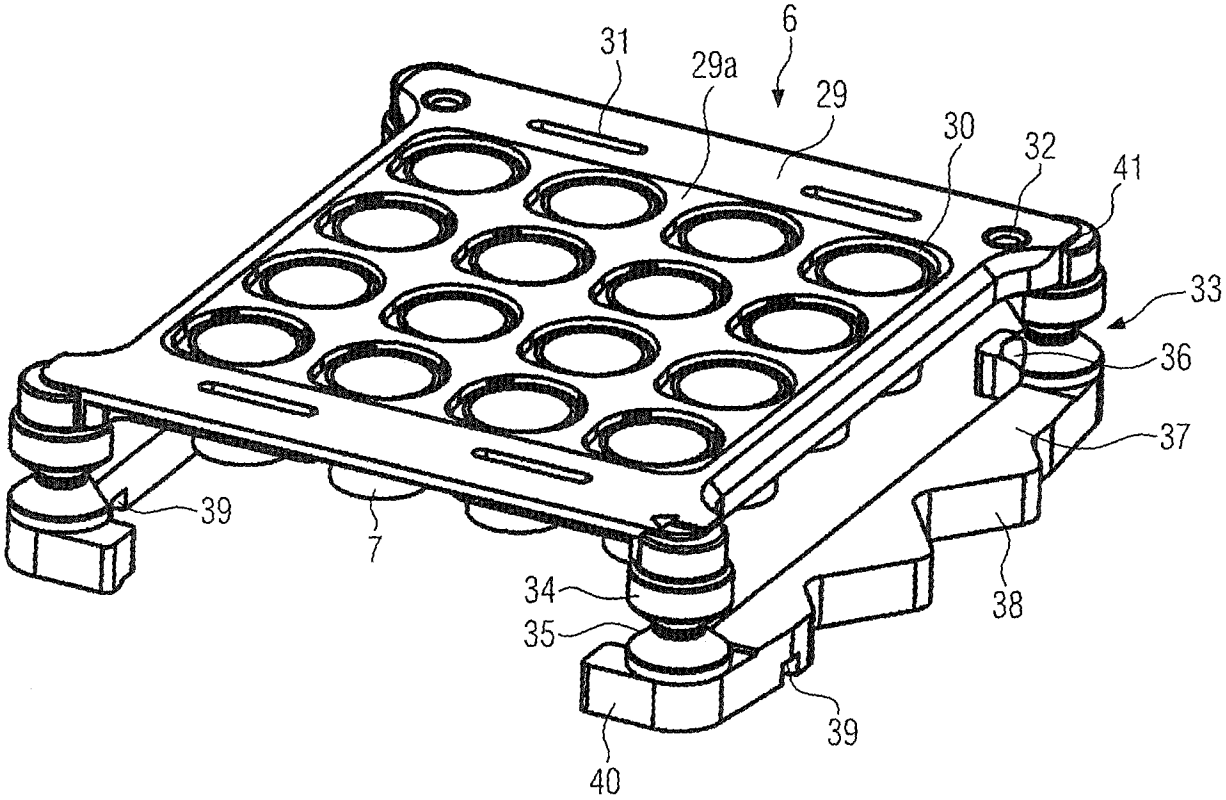
FIG. 10 is a perspective view of an object carrier according to one embodiment of the present invention.

FIG. 10 shows a perspective view of the object carrier 6. The object carrier 6 may comprise an upper part 29 that may be configured as a substantially rectangular metal plate and a plurality of packaging object accommodation means 30, such as sixteen packaging object accommodation means 30 as shown in FIG. 10. The packaging object accommodation means 30 may accommodate therein the packaging objects 7. The upper part 29 may include at opposed outer areas evacuation openings 31, such as two respective evacuation openings 31 in each of the opposed outer areas as shown in FIG. 10. Through the evacuation openings 31 a vacuum can be advanced from the tool upper part 10 down to the tool lower part 11 arranged below the object carrier 6. The upper part 29 of the object carrier 6 may additionally comprise centering holes 32 which may be located at the corners. These centering holes 32 may be engaged by the centering pins 13 mentioned hereinbefore in connection with FIG. 2, when the object carrier 6 has been moved into contact with the tool upper part 10.

The object carrier 6 may additionally comprise a lower part 33 on which the upper part 29 may be secured in position. According to FIG. 10, the lower part 33 may comprise four leg elements 34, each of them fixed to a corner area of the upper part 29. Each of the leg elements 34 may have the shape of a double cone and may comprise a tapering area 35, which may be adapted to be acted upon in particular by the conveying unit 23 as well as by other conveying means, such as those used for returning the object carrier 6. For accomplishing a particularly high hardness and wear resistance, the legs 34 may be produced from PA6 material. FIG. 10 also shows that the respective leg elements 34 may have notches 36 on their side facing inwards. These notches 36 may be used for precentering the object carrier 6 through the tool lower part 11.

According to FIG. 10, the lower part 33 may additionally comprise two rails 37, each of the rails 37 may be secured to two respective legs 34. The rails 37 serve to place the object carrier 6 on conveyor belts of the packaging system 1 (on the feed belt 5 and the discharge belt 8). The rails 37 may comprise each an aligning element 38, which, according to FIG. 10, may be configured as an undulated element or as a toothed bar. The aligning element 38 may be used for docking onto an object carrier 6 conveyed ahead of or after the object carrier 6 in question. Adjacent to the respective aligning elements 38, guide slots 39 may be provided on the respective rails 37. The guide slots 39 may be used for correctly orientating the object carrier 6 along its conveying path, the guide slots 39 being adapted to be attached to a guide plate (not shown), which may be provided along the conveying path. Thus, an operator can deposit the object carrier 6 on the conveyor belts with the correct orientation. In addition, the respective rails 37 may have a lateral guide element 40 on either side. The lateral guide element 40 may be configured such that it abuts on the guide frame 12 in the sealing station 9, so that the object carrier 6 is stably supported at the preliminary position. Finally, FIG. 10 shows a stacking projection 41 formed on the corners of the upper part 29. The stacking projection 41 allows for the object carriers 6 to be stacked stably one on top of the other. Last but not least, an insertion plate 29*a* may be secured in position in an insertion depression 29*b*, as shown in FIG. 11.

Figure 11:
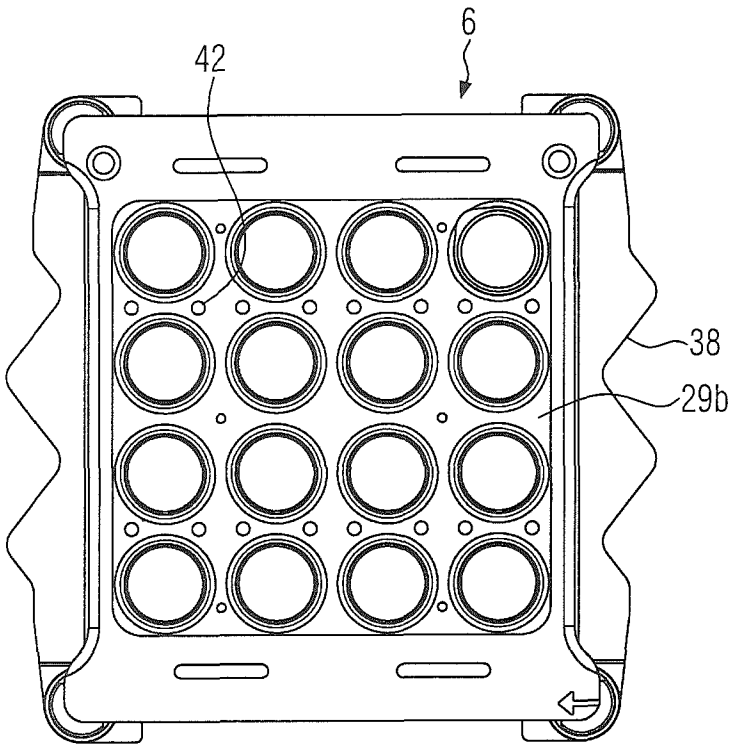
FIG. 11 is a top view of the object carrier in FIG. 10.

FIG. 11 shows the object carrier 6 in a top view, where the insertion plate 29*a* is being removed from the upper part 29 so that the insertion depression 29*b* is visible. In FIG. 11 it can easily be seen that the upper part 29 may comprise a plurality of openings 42. The openings 42 may be connected to the respective packaging object accommodation means 30 via a channel system provided in the upper part 29, in particular in the insertion plate 29*a* of the object carrier 6. The openings 42 may be the above-mentioned evacuation and/or gas flushing inlets.

In the top view of the object carrier 6 it can additionally be seen that the respective aligning elements 38 project from below the upper part 29, the projecting part corresponding substantially to the height of the toothing. This allows object carriers 6 that have been docked onto one another to move across conveyor belt gaps without drooping on one side thereof.

Figure 12:
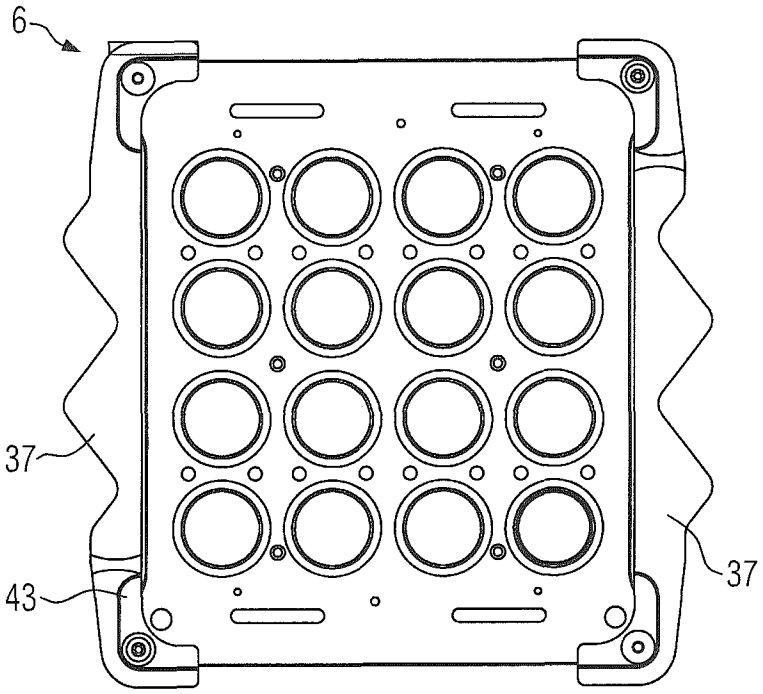
FIG. 12 is a bottom view of the object carrier in FIG. 10.

FIG. 12 shows the object carrier 6 from below. This view shows very clearly that the respective rails 37 may have cutout portions 43 on their corner areas, which facilitate stacking of a plurality of object carriers 6 and which, in particular, can be attached to the respective stacking projections 41.

Figure 13:
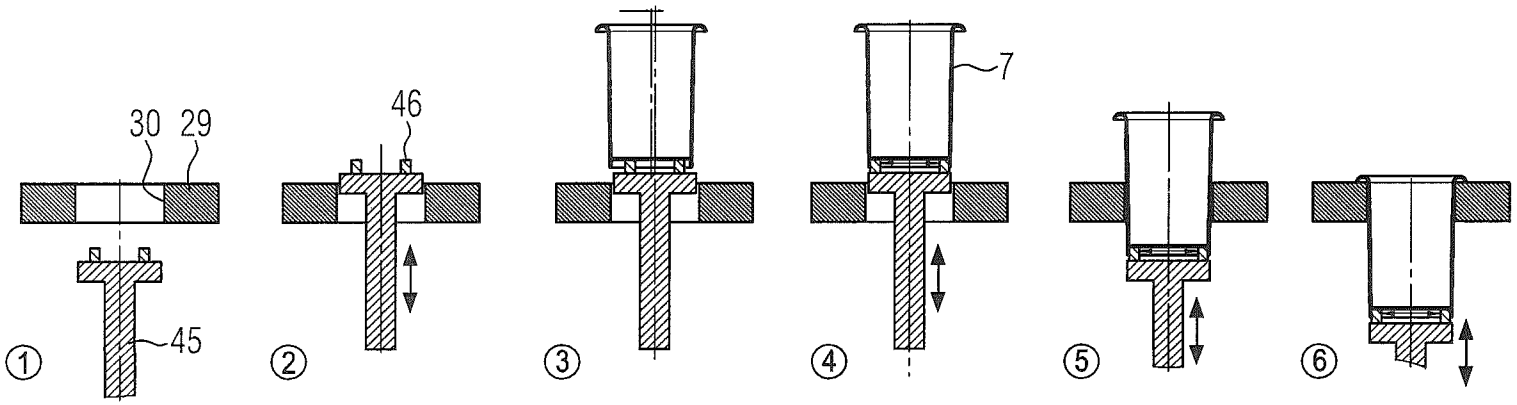
FIG. 13 is a schematic sectional side view illustrating a sequence of steps carried out by a centering unit, by means of which packaging objects can be centered in an upper part of an object carrier according to one embodiment of the present invention.

FIG. 13 shows a schematic sequence of steps for centering a packaging object 7 in a packaging object accommodation means 30 making use of a centering unit 44 that may be provided in the area of the infeed station 4. The centering unit 44 may include a pin 45, which may be vertically adjustable. The object carrier 6 may here be positioned above the centering unit 44 such that the pin 45 will pass through the packaging object accommodation means 30 and grasp the bottom of the packaging object 7 disposed thereabove. This is shown in steps 1 to 3 in FIG. 13. The pin 45 may have provided thereon two laterally displaceable jaws 46. As soon as the pin 45 abuts on the bottom of the packaging object 7, the jaws 46 can be displaced outwards (step 4) for centering the packaging object 7 on the pin 45. When this has been done, the pin 45 can move downwards according to step 5, thus pulling the packaging object 7 into the packaging object accommodation means 30. As soon as the pin 45 has arrived at a lower position, at which the packaging object 7 has fully been drawn into the packaging object accommodation means 30, the jaws 46 will open and release the packaging object 7 (step 6). Depending on the number of packaging object accommodation means 30 in the object carrier 6, a corresponding number of pins 45 can be provided in the centering unit 44.

Figure 14A:
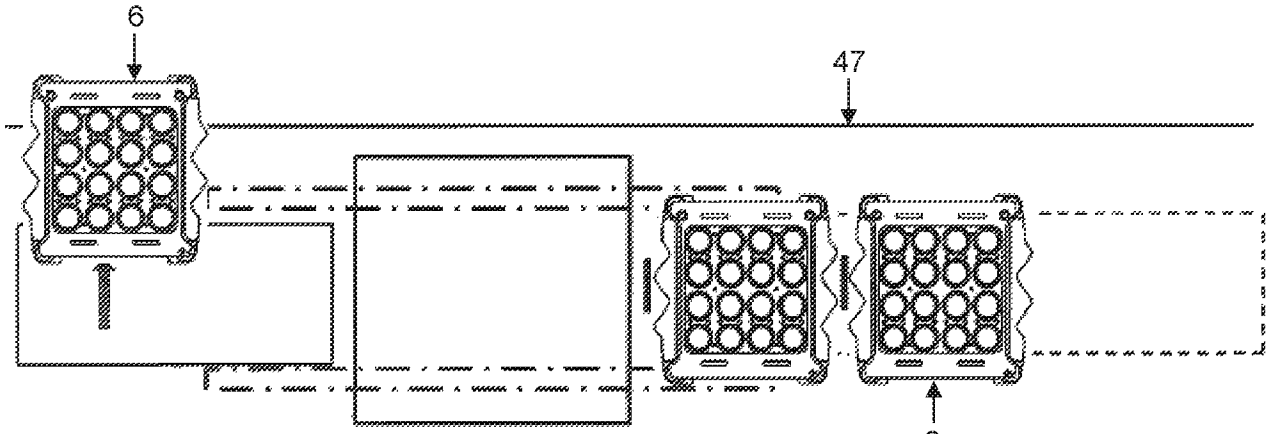
FIG. 14A is a schematic top view of a packaging machine with a return unit according to one embodiment of the present invention.
Figure 14B:
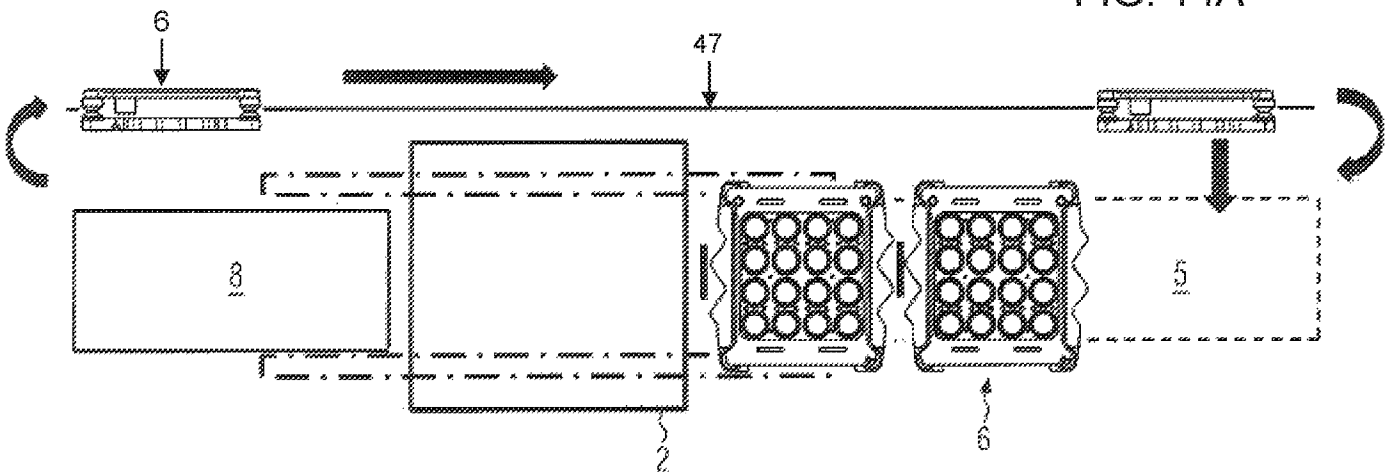
FIG. 14B is a schematic top view of the packaging machine of FIG. 14A with a return unit in a differing state of operation in accordance with the teachings of the present invention.

FIGS. 14A and 14B show a return unit 47 arranged alongside the packaging machine 2. FIG. 14B shows that by means of the return unit 47, the object carriers 6 can be conveyed back to the infeed station 4, which is not shown in FIG. 14B, in a condition in which they are tilted by 90°.

The present invention may also relate to individual ones or a plurality of the above-described features in an isolated manner. In particular the centering unit 44 as well as the object carrier 6 together with a lifting element may represent inventions of their own. The object carrier 6 may also be configured as a one-part component, such as a machined aluminum body.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to together features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specifications and the accompanying drawings. All such changes, modifications, variations and other uses and applications which do not depart from the spirit and scope of the invention are deemed to be covered by the invention which is limited only by the claims which follow.

What is claimed is:

1. A packaging machine comprising:

a sealing station;

a conveying unit and at least one loose container carrier, the at least one loose container carrier is configured for accommodating a plurality of packaging containers, and said conveying unit advances said at least one loose container carrier into and out of the sealing station; and wherein the at least one loose container carrier comprises an upper part for accommodating the plurality of packaging containers; and wherein for sealing the packaging containers, when the at least one loose container carrier is advanced into the sealing station, the at least one loose container carrier is movable within the sealing station from a preliminary position to a sealing position, wherein at the sealing position, the at least one loose container carrier is in contact with a tool upper part of the sealing station, said movement to said sealing position comprises said at least one loose container carrier being displaced in parallel relative to the preliminary position;

wherein the sealing station includes a tool lower part, and wherein the at least one loose container carrier is adapted to be picked up and lifted into contact with the tool upper part by the tool lower part.

2. The packaging machine according to claim 1, wherein the tool lower part is movable relative to the tool upper part between a position of rest and a sealing position, wherein when in the position of rest the tool upper part is spaced apart from the at least one loose container carrier, and wherein when in the sealing position the tool lower part presses the at least one loose container carrier against the tool upper part.

3. The packaging machine according to claim 1, wherein the tool upper part, the upper part of the at least one loose container carrier and the tool lower part define an air-tight sealing chamber.

4. The packaging machine according to claim 1, wherein the tool upper part and the upper part of the at least one loose container carrier are moved in contact with each other in a centered manner.

5. The packaging machine according to claim 1, wherein the conveying unit comprises a gripper unit, the gripper unit adapted for conveying the at least one loose container carrier into the sealing station and for conveying the at least one loose container carrier out of the sealing station.

6. The packaging machine according to claim 5, wherein the sealing station includes a guide frame on which the at least one loose container carrier is positioned preliminarily relative to the tool upper part.

7. The packaging machine according to claim 1, wherein the at least one loose container carrier comprises a lower part, wherein the upper part of the at least one loose container carrier is rigidly fixed in position on the lower part of the at least one loose container carrier.

8. The packaging machine according to claim 7, wherein the lower part of the at least one loose container carrier comprises first and second rails, wherein the upper part of the at least one loose container carrier is fixed to the first and second rails.

9. The packaging machine according to claim 8, wherein at least one of the first and second rails includes a guide slot, wherein the at least one loose container carrier is adapted to be oriented in a conveying direction by the respective guide slot.

10. The packaging machine according to claim 8, wherein the first and second rails each comprise an aligning element for aligning two successive loose container carriers relative to one another.

11. The packaging machine according to claim 1, wherein the sealing station is adapted for accommodating more than one loose container carrier during a sealing cycle.

12. The packaging machine according to claim 1, wherein the conveying unit comprises two drive belts laterally next to the sealing station, the two drive belts adapted for conveying the at least one loose container carrier into the sealing station and for conveying the at least one loose container carrier out of the sealing station.

13. A packaging system comprising a packaging machine according to claim 1, a take-off station for removing fully sealed packaging containers, and an infeed station for charging the at least one loose container carrier with a plurality of unsealed packaging containers.

14. The packaging system according to claim 13 further comprising a return unit adapted for providing a plurality of empty loose container carriers which are to be charged with at least one of said plurality of packaging containers in an unsealed condition.

15. A method of sealing a plurality of packaging containers, the method comprising the steps of:

positioning at least one loose container carrier charged with a plurality of packaging containers in an unsealed condition at a preliminary position within a sealing station relative to a tool upper part of the sealing station;

moving the at least one loose container carrier from its preliminary position to a sealing position by parallel displacement wherein the at least one loose container carrier is moved into contact with the tool upper part of the sealing station; and picking up the at least one loose container carrier by a tool lower part in the sealing station and lifting the at least one loose container carrier into contact with the tool upper part with the tool lower part when the at least one loose container carrier is moved from the preliminary position to the sealing position, and sealing said plurality of packaging containers at the sealing position.

16. The method according to claim 15, further comprising accommodating two or more loose container carriers in the sealing station during a sealing cycle.

* * * * *